US009758925B2

(12) United States Patent
Kimura et al.

(10) Patent No.: US 9,758,925 B2
(45) Date of Patent: Sep. 12, 2017

(54) MOLDED OBJECT HAVING NONWOVEN FIBROUS STRUCTURE

(75) Inventors: Tomoaki Kimura, Osaka (JP); Yasuro Araida, Osaka (JP); Toru Ochiai, Okayama (JP); Sumito Kiyooka, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 1626 days.

(21) Appl. No.: 12/294,352

(22) PCT Filed: Mar. 26, 2007

(86) PCT No.: PCT/JP2007/056183

§ 371 (c)(1),
(2), (4) Date: Sep. 24, 2008

(87) PCT Pub. No.: WO2007/116676

PCT Pub. Date: Oct. 18, 2007

(65) Prior Publication Data

US 2009/0130939 A1 May 21, 2009

(30) Foreign Application Priority Data

Mar. 31, 2006 (JP) ..... 2006-098097
Oct. 6, 2006 (JP) ..... 2006-274882

(51) Int. Cl.
*D04H 1/558* (2012.01)
*D04H 1/4382* (2012.01)
(Continued)

(52) U.S. Cl.
CPC ..... *D06M 11/82* (2013.01); *A47L 13/16* (2013.01); *B43K 8/022* (2013.01); *B43L 19/04* (2013.01);
(Continued)

(58) Field of Classification Search
CPC ..... D06M 11/82; D06M 15/643; D06M 2200/30; D04H 1/54; D04H 1/5405;
(Continued)

(56) References Cited

U.S. PATENT DOCUMENTS 5,304,420 A * 4/1994 Hirakawa et al. ..... 428/373
2003/0118814 A1* 6/2003 Workman et al. ..... 428/365
2003/0119405 A1* 6/2003 Abuto et al. ..... 442/361

FOREIGN PATENT DOCUMENTS

EP 0 432 489 A2 6/1991
EP 0 432 489 A3 6/1991
(Continued)

OTHER PUBLICATIONS

Engineers Toolbox, http://www.engineeringtoolbox.com/thermal-conductivity-d_429.html. (Downloaded from the internet Jun. 18, 2011).*

*Primary Examiner* — Frank Vineis
(74) *Attorney, Agent, or Firm* — Oblon, McClelland, Maier & Neustadt, L.L.P.

(57) ABSTRACT

To prepare a shaped product comprising a thermal adhesive fiber under moisture and having a fiber aggregate nonwoven structure. In the shaped product, the thermal adhesive fibers under moisture are melted to bond to fibers constituting the fiber aggregate nonwoven structure and the bonded fiber ratio is not more than 85%. The shaped product has an apparent density of 0.05 to 0.7 g/cm$^3$, a maximum bending stress of not less than 0.05 MPa in at least one direction, and a bending stress of not less than ⅕ of the maximum bending stress at 1.5 times as large as the bending deflection at the maximum bending stress. The moistenable-thermal adhesive fiber may be a sheath-core form conjugated fiber comprising a sheath part comprising an ethylene-vinyl alcohol-series copolymer and a core part comprising a polyester-series resin. Such a shaped product can be used for a building
(Continued)

board or the like since the shaped product has a high bending stress although the product is light and has a low density.

15 Claims, 2 Drawing Sheets

(51) Int. Cl.

| | |
|---|---|
| ***D04H 1/435*** | (2012.01) |
| ***D04H 1/4309*** | (2012.01) |
| ***D04H 1/54*** | (2012.01) |
| ***D06M 11/82*** | (2006.01) |
| ***E04C 2/16*** | (2006.01) |
| ***B43L 19/04*** | (2006.01) |
| ***E04B 1/90*** | (2006.01) |
| ***A47L 13/16*** | (2006.01) |
| ***D06M 15/643*** | (2006.01) |
| ***B43K 8/02*** | (2006.01) |

(52) U.S. Cl.
CPC ..... *D04H 1/435* (2013.01); *D04H 1/4309* (2013.01); *D04H 1/4382* (2013.01); *D04H 1/54* (2013.01); *D04H 1/558* (2013.01); *D06M 15/643* (2013.01); *E04B 1/90* (2013.01); *E04C 2/16* (2013.01); *D06M 2200/30* (2013.01); *Y10T 442/641* (2015.04); *Y10T 442/696* (2015.04); *Y10T 442/697* (2015.04)

(58) Field of Classification Search
CPC ..... D04H 1/541; D04H 1/542; D04H 1/545; D04H 1/558; D04H 1/4382; D04H 1/435; D04H 1/4309; B43L 19/04; B43K 8/022; E04C 2/16; E04B 1/90; A47L 13/16; Y10T 442/696; Y10T 442/641; Y10T 442/697
USPC ..... 442/327, 364, 409, 411, 415; 428/195.1, 428/198
See application file for complete search history.

(56) References Cited

FOREIGN PATENT DOCUMENTS

| | | |
|---|---|---|
| EP | 0 625 603 A1 | 11/1994 |
| EP | 0 719 355 | 7/1996 |
| EP | 1 094 140 A1 | 4/2001 |
| JP | 63 235558 | 9/1988 |
| JP | 63 270102 | 11/1988 |
| JP | 6 31708 | 2/1994 |
| JP | 6 155662 | 6/1994 |
| JP | 6 321610 | 11/1994 |
| JP | 2001 123368 | 5/2001 |
| JP | 2001 172853 | 6/2001 |
| JP | 2002 115161 | 4/2002 |
| JP | 2003 221453 | 8/2003 |
| JP | 2003 336170 | 11/2003 |
| JP | 2004 314592 | 11/2004 |
| JP | 2005 76162 | 3/2005 |
| JP | 2006 2299 | 1/2006 |
| JP | 2006 116854 | 5/2006 |

* cited by examiner

MOLDED OBJECT HAVING NONWOVEN FIBROUS STRUCTURE

TECHNICAL FIELD

The present invention relates to a shaped product which has lightness in weight (or is light weight) and a high air permeability and mainly comprises a fiber alone and is free from a resin for filling up the voids between the fibers, a chemical binder, a special agent, or the like.

BACKGROUND ART

Nonwoven fabrics (cloths) comprising a natural fiber or a synthetic fiber have been widely used not only for hygiene or medical applications (such as a disposal diaper or a wet wiper) and clothing applications, but also for industrial applications. The nonwoven fabrics are thus important to wide-ranging applications including a common material for living, an industrial material, and the like. In particular, a highly soft nonwoven fabric (usually such as a needle-punched nonwoven fabric or a hot-airthrough-nonwoven fabric) is in widespread use as a bulky and light nonwoven fabric. In order to impart hardness to such a soft nonwoven fabric, it is necessary to process the soft nonwoven fabric by a treatment such as a heat-press treatment or a resin impregnation.

However, in a heat-pressed nonwoven fabric only the fibers close to a surface of the nonwoven fabric are bonded to each other (or together), but the fibers inside the nonwoven fabric are not enough bonded to each other. It is thus difficult to produce a nonwoven fabric having an enough hardness by the heat-press treatment. Since it is necessary that the inner fibers be also melt-bonded together firmly to impart an enough hardness to the nonwoven fabric, in the heat-press treatment, the nonwoven fabric has to be subjected to an excessive heating due to its slow heat transfer to the inner fibers. However, the excessively heated nonwoven fabric has surfaces in which the fibers are more strongly or firmly bonded together to form high-density layers. After all, even with the excessive heating it is difficult to impart a sufficient hardness to the nonwoven fabric. Furthermore, in a nonwoven fabric impregnated with a resin for imparting hardness thereto, the voids between the fibers in the nonwoven fabric are filled up with the resin, which consequently render the nonwoven fabric highly dense.

In addition, Japanese Patent Application Laid-Open No. 314592/2004 (JP-2004-314592A, Patent Document 1) discloses a fiber aggregate board comprising kenaf fibers, which is obtained by fibrillating a kenaf, bonded together with a thermosetting adhesive agent as a hard nonwoven fabric board comprising a natural fiber. The fiber board has a density of 600 to 900 kg/m$^3$. This fiber board is generally referred to as "kenaf board". Although the kenaf, a raw material for the kenaf board, is a natural fiber, the kenaf fiber is impregnated with an adhesive agent and subjected to a press to form a board material at a board forming step. Such a kenaf board is used as an alternative to a wood or a timber for a building material (e.g., a roof cover and a flooring material), furniture (e.g., a storage case, a built-in kitchen, and a closet), an electrical equipment (e.g., a speaker), a musical instrument (e.g., a piano and an organ), or a table-tennis table.

However, the use of a phenolicresin-series adhesive agent or the like is inevitable for producing the board having an enough hardness or strength from the kenaf as a raw material. Thus there arises a concern about a danger to public health due to a formaldehyde emission or generation from the board. Moreover, the kenaf board was developed as an alternative to a wood or a timber as mentioned above and has no air-permeability or a very low air-permeability.

Furthermore, boards used for applications [for example, a filter for an automobile or a machine, a fan filter, a building material, or a furniture (such as a built-in kitchen)] require flame retardancy besides hardness. A flame-retardant board is commonly known as such a board. The flame retardancy thereof is attained by impregnating glass fibers with a flame-retardant resin or by adding a flame retardant containing a halogenated compound or an antimony compound to a board in a post-processing. For example, Japanese Patent Application Laid-Open No. 221453/2003 (JP-2003-221453A, Patent Document 2) discloses a polyester fiber board having rigidity and flame retardancy as a hard and flame-retardant board comprising a synthetic fiber. The polyester fiber board is obtained by forming a composite coating comprising an organic binder and an inorganic powder on a surface of a polyester fiber or by filling a composite material comprising an organic binder and an inorganic powder into the pores of a board comprising a polyester fiber. This document teaches that slurry comprising an inorganic powder and an organic binder is injected by pressure into a nonwoven fabric comprising a polyester fiber to impart rigidity and flame retardancy to the board.

However, the complex step of the process for the slurry injection into the nonwoven fabric and the time-consuming slurry injection prevent the quality assurance and the increase of the processing speed. Moreover, in the process, the voids between the fibers constituting the nonwoven fabric are filled up with the inorganic powder or the binder, whereby the density and weight are increased.

On the one hand, a wood fiberboard (e.g., a particle board and an MDF: Medium Density Fiber Board) is known as a board material having a lightness in weight and a high bending strength, which is made of wood chips as a main raw material and an adhesive agent and formed by virtue of heat and pressure [see Japanese Patent Application Laid-Open No. 31708/1994 (JP-6-31708A, Patent Document 3), Japanese Patent Application Laid-Open No. 155662/1994 (JP-6-155662A, Patent Document 4), and Japanese Patent Application Laid-Open No. 116854/2006 (JP-2006-116854A, Patent Document 5)].

However, the wood fiber board is usually heavy and imposes physical strains on workers installing the board. Additionally, during bending the wood fiber board by applying a high impact or a load thereon, the board is suddenly broken and easily damaged. Moreover, the wood fiber board reuses a wood waste with an intention for preserving resources. The wood fiber board is developed for the above-mentioned applications as an alternative to a wood or a timber and usually has no air-permeability as well as the kenaf board. Furthermore, the wood fiber board often contains a melamine resin as an adhesive agent, whereby formaldehyde is emitted from the board.

On the other hand, Japanese Patent Application Laid-Open No. 235558/1988 (JP-63-235558A, Patent Document 6) discloses a nonwoven fabric comprising an ethylene-vinyl alcohol copolymer fiber having a predetermined mole ratio of ethylene as a nonwoven fabric comprising a thermal (heat) adhesive fiber under wet. An object in this document is to obtain a nonwoven fabric which is bulky, soft, and strong enough. To achieve the above-mentioned object, the ethylene-vinyl alcohol copolymer is firmly bonded together by allowing the copolymer to swell in water and heating the swollen copolymer in contact with a heater (or a heating element). That is, the obtained nonwoven fabric is soft, not hard.

Moreover, Japanese Patent Application Laid-Open No. 123368/2001 (JP-2001-123368A, Patent Document 7) discloses a self-forming porous fiber aggregate containing fiber webs bonded together firmly as a light-weight and bulky fiber aggregate nonwoven structure. The self-forming porous fiber aggregate is obtained by heating the fiber web to bond an ethylene-vinyl alcohol copolymer fiber to fibers constituting the fiber aggregate by a wet and heat treatment. In this document, the above-mentioned fiber aggregate having cell-like voids formed therein is produced by immersing a fiber aggregate nonwoven structure comprising a thermal (heat) adhesive fiber under wet in water having a room temperature, subjecting the fiber aggregate nonwoven structure containing the water to a wet-heat treatment in which the fiber aggregate nonwoven structure is heated at about 100° C. to generate air bubble therein, and cooling the resulting fiber aggregate nonwoven structure.

Owing to the internally formed cell-like voids, the fiber aggregate nonwoven structure is bulky and light. However, the fiber aggregate nonwoven structure easily deforms or breaks at a part or area having such voids. It is still difficult to provide the fiber aggregate nonwoven structure having a high hardness.

[Patent Document 1] JP-2004-314592A
[Patent Document 2] JP-2003-221453A
[Patent Document 3] JP-6-31708A
[Patent Document 4] JP-6-155662A
[Patent Document 5] JP-2006-116854A
[Patent Document 6] JP-63-235558A
[Patent Document 7] JP-2001-123368A

DISCLOSURE OF THE INVENTION

Problems to be Solved by the Invention

It is therefore an object of the present invention to provide a shaped product which has a high bending stress although the shaped product is light and has a low density.

Another object of the present invention is to provide a shaped product which has a high hardness, a superb folding endurance, and an excellent toughness together with air-permeability and thermal insulation property.

A further object of the present invention is to provide a shaped product having a fiber aggregate nonwoven structure (or nonwoven fiber aggregate structure or nonwoven fabric structure) which can be produced easily without using harmful components.

Means to Solve the Problems

The inventors of the present invention made intensive studies to achieve the above objects and finally found that a fiber aggregate nonwoven structure in which thermal (heat) adhesive fibers under moisture are melt to bond to fibers constituting the fiber aggregate nonwoven structure at spaced and discrete points or areas has a high bending stress although the fiber aggregate nonwoven structure is light and a low density. The present invention was accomplished based on the above findings.

That is, the shaped product of the present invention comprises a thermal (heat) adhesive fiber under moisture and having a fiber aggregate nonwoven structure (nonwoven fiber aggregate structure or nonwoven fabric structure). In the shaped product, the thermal adhesive fibers under moisture are melted to bond to fibers constituting the fiber aggregate nonwoven structure and the bonded fiber ratio is not more than 85%. The shaped product has an apparent density of 0.05 to 0.7 g/cm$^3$, a maximum bending stress of not less than 0.05 MPa in at least one direction, and a bending stress of not less than ⅕ of the maximum bending stress at 1.5 times as large as the bending deflection at the maximum bending stress. The shaped product may have an apparent density of 0.2 to 0.7 g/cm$^3$ and may have a bending stress of not less than ⅓ of the maximum bending stress at 1.5 times as large as bending deflection at the maximum bending stress. In addition, providing that the shaped product is cut across the thickness direction and the cross section is divided in a direction perpendicular to the thickness direction equally into three to give the three areas, the bonded fiber ratio in each of three areas may be not more than 85% and the difference between the maximum and minimum bonded fiber ratios in each of three areas may be not more than 20%. Moreover, in each of the areas mentioned above, the fiber-occupancy ratio may be 20 to 80% and a difference between the maximum and minimum fiber-occupancy ratios may be not more than 20%. Since the shaped product of the present invention has the fiber aggregate nonwoven structure, the shaped product has a high air-permeability. For example, the air-permeability may be about 0.1 to 300 cm$^3$/cm$^2$/second measured in accordance with a Fragzier tester method. In addition, the shaped product has a high heat insulation property, and the heat conductivity of the shaped product may be about 0.03 to 0.1 W/m·K. The shaped product of the present invention further comprises a non thermal (heat) adhesive fiber under moisture. The proportion (mass ratio) of the thermal adhesive fiber under moisture relative to the non thermal adhesive fiber under moisture (the thermal adhesive fiber under moisture/the non thermal adhesive fiber under moisture) may be about 20/80 to 100/0. The thermal adhesive fiber under moisture may comprise an ethylene-vinyl alcohol-series copolymer and a non thermal adhesive resin under moisture. When the thermal adhesive fiber under moisture comprises the ethylene-vinyl alcohol-series copolymer and the non thermal adhesive resin under moisture, the proportion (mass ratio) of the ethylene-vinyl alcohol-series copolymer relative to the non thermal adhesive resin under moisture [the former/the latter] may be 90/10 to 10/90, and the ethylene-vinyl alcohol-series copolymer may form at least one continuous area of the surface of the thermal adhesive fiber under moisture in the fiber length. In particular, the thermal adhesive fiber under moisture may be a sheath-core form conjugated (composite) fiber which comprises a sheath part comprising a thermal adhesive resin under moisture (e.g., an ethylene-vinyl alcohol-series copolymer whose content of ethylene unit is 10 to 60 mol %) and a core part comprising a non thermal adhesive resin under moisture (e.g., a polypropylene-series resin, a polyester-series resin, and a polyamide-series resin). The shaped product of the present invention may comprise at least one selected from the group consisting of a boron-containing flame retardant and a silicon-containing flame retardant. The shaped product can be used for applications requiring heat insulation property and/or air-permeability. The present invention may include a building board comprising the shaped product mentioned above.

The shaped product of the present invention comprises a thermal adhesive fiber under moisture and a fiber aggregate nonwoven structure. The product substantially comprises the fibers and is not impregnated with a resin. In addition, the fiber structure is formed not by mechanically entangling (e.g., needle-punching), but by melting the thermal adhesive fibers under moisture to bond the fibers constituting the fiber aggregate nonwoven structure in order to prevent a fiber from being arranged (or a fiber length direction from being set) in a direction parallel to the thickness direction of the shaped product.

Effects of the Invention

The shaped product of the present invention having a fiber aggregate nonwoven structure is obtained by allowing the thermal adhesive fibers under moisture to melt and bond to fibers constituting the fiber aggregate nonwoven structure at spaced and discrete points or areas. The shaped product has a high bending stress although the shaped product is light and has a low density. In addition, the shaped product has a high hardness, a superb folding endurance, and an excellent toughness together with air-permeability and thermal insulation property. That is, when a load is applied on a surface of the shaped product having a board (or plate)-like shape, the board does not tend to have a partial deformation or dent but curves (or bents) or deforms to absorb the applied stress. Such a board has a high impact resistance and is not easily damaged or broken even by applying a huge impact thereon. Moreover, since the shaped product can substantially comprise fibers alone and requires no addition of a chemical binder or a special agent, the shaped product can be produced easily without using a component emitting a harmful component (e.g., a volatile organic compound such as formaldehyde).

DETAILED DESCRIPTION OF THE INVENTION

Figure 1:
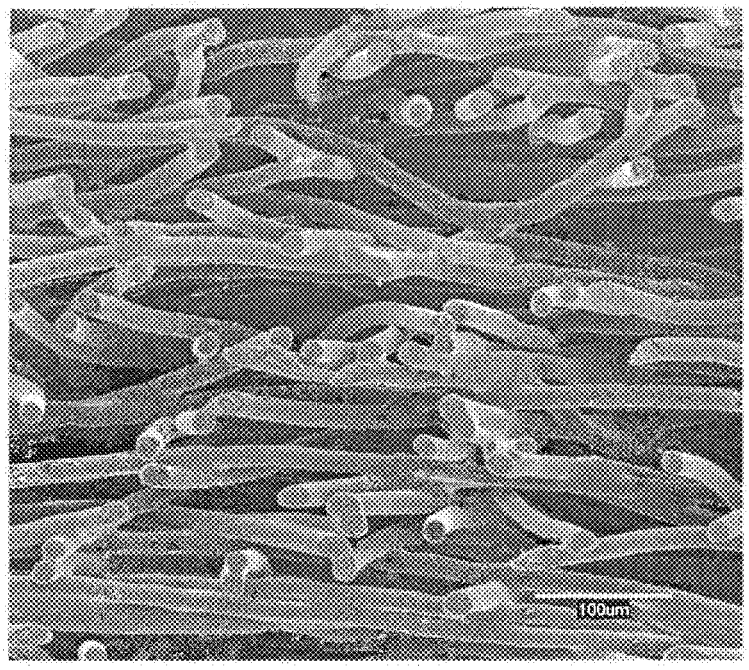
FIG. 1 is an electron micrograph (200 magnifications) of an area around middle (central) of the cross section with respect to the thickness direction of the shaped product obtained in Example 1.

The shaped product of the present invention comprises a thermal adhesive fiber under moisture and has a fiber aggregate nonwoven structure. In particular, the shaped product has a specific arrangement (or direction) of the fibers constituting the fiber aggregate nonwoven structure and a specific state in which the fibers constituting the fiber aggregate nonwoven structure are bond together, whereby the shaped product has "bending behavior", "lightness in weight", and "hardness of the compression", all of which an ordinary nonwoven fabric cannot afford, besides bending endurance, a shape retention property, and air-permeability. Incidentally, the "bending behavior" means as follows: besides, the shaped product shows a high bending stress at bending the shaped product, the shaped product not only maintains the stress when the shaped product is kept bending even after exceeding the maximum point of bending stress but also starts to restore the original shape after releasing the stress. In addition, the "hardness of the compression" means that the shaped product is not easily deformed by a force due to a load applied on the surface thereof in the thickness direction.

Such a shaped product is, as described later in detail, obtained by applying a high-temperature (super-heated or heated) water vapor (or steam) on a web comprising the thermal adhesive fiber under moisture to induce the adhesiveness of the thermal adhesive fiber under moisture (or to bring the thermal adhesive fiber under moisture into an adhesive state) at a temperature of not higher than the melting point of the adhesive fiber and bonding the fibers constituting the web partly to each other to aggregate the fibers. That is, the shaped product is obtained by bonding of mono-fibers and bundles of the aggregated fibers at contact points or areas thereof as if forming a jungle-gym (a three-dimensional crosslinking) of the fibers, under a moist and heat condition or state, to form tiny voids between the fibers.

(Material for Shaped Product)

The thermal adhesive fiber under moisture comprises at least a thermal adhesive resin under moisture. It is sufficient that the thermal adhesive resin under moisture can flow (or melt) or easily deform and exhibits adhesiveness at a temperature reached easily with an aid of a high-temperature water vapor. Specifically, the thermal adhesive resin under moisture may include, for example, a thermoplastic resin which softens with (or by) a hot water (e.g., a water having a temperature of about 80 to 120° C. and particularly about 95 to 100° C.) to bond to itself or to other fibers. Such a thermal adhesive resin under moisture may include, for example, a cellulose-series resin (e.g., a $C_{1-3}$alkyl cellulose ether such as methyl cellulose, a hydroxy$C_{1-3}$alkyl cellulose ether such as hydroxymethyl cellulose, a carboxy$C_{1-3}$alkyl cellulose ether such as carboxymethyl cellulose, or a salt thereof), a polyalkylene glycol resin (e.g., a poly $C_{2-4}$alkylene oxide such as a polyethylene oxide or a polypropylene oxide), a polyvinyl-series resin (e.g., a polyvinyl pyrrolidone, a polyvinyl ether, a vinyl alcohol-series polymer, and a polyvinyl acetal), an acrylic copolymer and a salt of an alkali metal therewith [e.g., a copolymer containing an acrylic monomer unit such as (meth)acrylic acid or (meth) acrylamide, or a salt of copolymer], a modified vinyl-series copolymer [e.g., a copolymer of an unsaturated carboxylic acid or an acid anhydride thereof (such as maleic anhydride) and a vinyl monomer (such as isobutylene, styrene, ethylene, or vinyl ether), or a salt of the copolymer], a polymer having a hydrophilic substituent introduced therein (e.g., a polyester, a polyamide, a polystyrene, which have a sulfonic acid group, a carboxyl group, a hydroxyl group, or the like introduced therein, or a salt of the polymer), and an aliphatic polyester-series resin (e.g., a polylactic acid-series resin). Moreover, the thermal adhesive resin under moisture may include a resin which softens at a temperature of a hot water (a high-temperature water vapor) to become adhesive, among a polyolefinic resin, a polyester-series resin, a polyamide-series resin, a polyurethane-series resin, and a thermoplastic elastomer or a rubber (e.g., a styrenic elastomer).

These thermal adhesive resins under moisture may be used singly or in combination. The thermal adhesive resin under moisture may usually comprise a hydrophilic polymer or a water-soluble resin. Among the thermal adhesive resins under moisture, the preferred one includes a vinyl alcohol-series polymer (e.g., an ethylene-vinyl alcohol copolymer), a polylactic acid-series resin (e.g., a polylactic acid), a (meth)acrylic copolymer containing a (meth)acrylic amide unit, particularly, a vinyl alcohol-series polymer containing an $\alpha$-$C_{2-10}$olefin unit such as ethylene or propylene, particularly, or an ethylene-vinyl alcohol-series copolymer.

The ethylene unit content in the ethylene-vinyl alcohol-series copolymer (the degree of copolymerization) may be, for example, about 10 to 60 mol %, preferably about 20 to 55 mol %, more preferably about 30 to 50 mol %. The ethylene unit content within the above-mentioned range provides a thermal resin under moisture having a unique behavior. That is, the thermal resin under moisture has thermal adhesiveness under moisture and insolubility in hot water. An ethylene-vinyl alcohol-series copolymer having an excessively small ethylene unit content readily swells or becomes a gel by a water vapor having a low temperature (or by water), whereby the copolymer readily deforms when once getting wet. On the other hand, an ethylene-vinyl alcohol-series copolymer having an excessively large ethylene unit content has a low hygroscopicity. In such a case, it is difficult to allow the copolymer to melt and bond the fibers constituting the fiber aggregate nonwoven structure by an application of moisture and heat, whereby it is difficult to produce a shaped product having strength for practical use. The ethylene unit content is, in particular, in the range of 30 to 50 mol % provides a product having an excellent processability (or formability) into a sheet or a plate.

The degree of saponification of vinyl alcohol unit in the ethylene-vinyl alcohol-series copolymer is, for example, about 90 to 99.99 mol %, preferably about 95 to 99.98 mol %, and more preferably about 96 to 99.97 mol %. An excessively small degree of saponification degrades the heat stability of the copolymer to cause a thermal decomposition or a gelation, whereby the stability of the copolymer is deteriorated. On the other hand, an excessively large degree of saponification makes the production of the thermal adhesive fiber under moisture difficult.

The viscosity-average molecular weight of the ethylene-vinyl alcohol-series copolymer can be selected according to need, and is for example, about 200 to 2500, preferably about 300 to 2000, and more preferably about 400 to 1500. An ethylene-vinyl alcohol-series copolymer having a viscosity-average molecular weight within the above-mentioned range provides a thermal adhesive fiber under moisture having an excellent balance between spinning property and thermal adhesiveness under moisture.

The cross-sectional form of the thermal adhesive fiber under moisture (a form or shape of a cross section perpendicular to the length direction of the fiber) may include not only a common solid-core cross section such as a circular cross section or a deformed (or modified) cross section [e.g., a flat form, an oval (or elliptical) form, a polygonal form, a multi-leaves form from tri-leaves to 14-leaves, a T-shaped form, an H-shaped form, a V-shaped form, and a dog-bone form (I-shaped form)], but also a hollow cross-section. The thermal adhesive fiber under moisture may be a conjugated (or composite) fiber comprising a plurality of resins, at least one of which is the thermal adhesive resin under moisture. The conjugated fiber has the thermal adhesive resin under moisture at least on part or areas of the surface thereof. In order to bond the fibers, it is preferable that the thermal adhesive resin under moisture form a continuous area of the surface of the conjugated fiber in the length direction of the conjugated fiber.

The cross-sectional structure of the conjugated fiber having the thermal adhesive fiber under moisture partly on the surface thereof, may include, e.g., a sheath-core form, an islands-in-the-sea form, a side-by-side form or a multi-layer laminated form, a radially-laminated form, and a random composite form. Among these cross-sectional structures, the structure preferred in terms of a high adhesiveness includes a sheath-core form structure in which the thermal adhesive resin under moisture continuously forms the entire surface of the fiber in the length direction (that is, a sheath-core structure in which a sheath part comprises the thermal adhesive resin under moisture).

The conjugated fiber may comprise a combination of two or more of the thermal adhesive resins under moisture or a combination of the thermal adhesive resin under moisture and a non thermal adhesive resin under moisture. The non thermal adhesive resin under moisture may include a non water-soluble or hydrophobic resin, e.g., a polyolefinic resin, a (meth)acrylic resin, a vinyl chloride-series resin, a styrenic resin, a polyester-series resin, a polyamide-series resin, a polycarbonate-series resin, a polyurethane-series resin, and a thermoplastic elastomer. These non thermal adhesive resins under moisture may be used singly or in combination.

Among these non thermal adhesive resins under moisture, in terms of excellent heat resistance and dimensional stability, the preferred one includes a resin having a melting point higher than that of the thermal adhesive resin under moisture (particularly an ethylene-vinyl alcohol-series copolymer), for example, a polypropylene-series resin, a polyester-series resin, and a polyamide-series resin. In particular, the resin preferred in terms of an excellent balance of properties (e.g., both heat resistance and fiber processability) includes a polyester-series resin or a polyamide-series resin.

The preferred polyester-series resin includes an aromatic polyester-series resin such as a poly$C_{2-4}$alkylene arylate-series resin (e.g., a polyethylene terephthalate (PET), a polytrimethylene terephthalate, a polybutylene terephthalate, and a polyethylene naphthalate), particularly, a polyethylene terephthalate-series resin such as a PET. The polyethylene terephthalate-series resin may contain, in addition to an ethylene terephthalate unit, a unit comprising other components in the proportion not more than 20 mol %. Incidentally, the above-mentioned other component may include a dicarboxylic acid (e.g., isophthalic acid, naphthalene-2,6-dicarboxylic aid, phthalic acid, 4,4'-diphenylcarboxylic acid, bis(carboxyphenyl)ethane, and sodium 5-sulfoisophthalate) and a diol (e.g., diethylene glycol, 1,3-propanediol, 1,4-butanediol, 1,6-hexanediol, neopentyl glycol, cyclohexane-1,4-dimethanol, a polyethylene glycol, and a polytetramethylene glycol).

The preferred polyamide-series resin includes, e.g., an aliphatic polyamide (such as a polyamide 6, a polyamide 66, a polyamide 610, a polyamide 10, a polyamide 12, or a polyamide 6-12) and a copolymer thereof and a semiaromatic polyamide synthesized from an aromatic dicarboxylic acid and an aliphatic diamine. These polyamide-series resins may also contain other copolymerizable units.

The proportion (mass ratio) of the thermal adhesive resin under moisture relative to the non thermal adhesive resin under moisture (a fiber-forming polymer) in the conjugated fiber can be selected according to the structure (e.g., a sheath-core form structure) and is not particularly limited to a specific one as long as the thermal adhesive resin under moisture is present on or forms the surface of the thermal adhesive fiber under moisture. For example, the proportion of the thermal adhesive resin under moisture relative to the non thermal adhesive resin under moisture is about 90/10 to 10/90, preferably about 80/20 to 15/85, and more preferably about 60/40 to 20/80. An excessively large proportion of the thermal adhesive resin under moisture does not provide a conjugated fiber having strength. An excessively small proportion of the thermal adhesive resin under moisture makes it difficult to allow the thermal adhesive resin under moisture to be present on the surface of the conjugated fiber continuously in the length direction of the conjugated fiber, which lowers the thermal adhesiveness under moisture of the conjugated fiber. Such a tendency also appears in the conjugated fiber obtained by coating the surface of the non thermal adhesive fiber under moisture with the thermal adhesive resin under moisture.

The average fineness of the thermal adhesive fiber under moisture can be selected, according to the applications, for example, from the range of about 0.01 to 100 dtex, preferably about 0.1 to 50 dtex, and more preferably about 0.5 to 30 dtex (particularly about 1 to 10 dtex). A thermal adhesive fiber under moisture having an average fineness within the above-mentioned range has an excellent balance of strength and thermal adhesiveness under moisture.

The average fiber length of the thermal adhesive fiber under moisture can be selected from, for example, the range of about 10 to 100 mm, preferably about 20 to 80 mm, and more preferably about 25 to 75 mm (particularly about 35 to 55 mm). A thermal adhesive fiber under moisture having an average fiber length within the above-mentioned range entangles with other fibers enough, whereby the mechanical strength of the shaped product is improved.

The percentage of crimp of the thermal adhesive fiber under moisture is, for example, about 1 to 50%, preferably about 3 to 40%, and more preferably about 5 to 30% (particularly about 10 to 20%). Moreover, the number of crimps is, for example, about 1 to 100 per inch, preferably about 5 to 50 per inch, and more preferably about 10 to 30 per inch.

the shaped product of the present invention may further comprise a non thermal adhesive fiber under moisture. The non thermal adhesive fiber under moisture may include, for example, a polyester-series fiber (e.g., an aromatic polyester fiber such as a polyethylene terephthalate fiber, a polytrimethylene terephthalate fiber, a polybutylene terephthalate fiber, or a polyethylene naphthalate fiber), a polyamide-series fiber (e.g., an aliphatic polyamide-series fiber such as a polyamide 6, a polyamide 66, a polyamide 11, a polyamide 12, a polyamide 610, or a polyamide 612, a semiaromatic polyamide-series fiber, and an aromatic polyamide-series fiber such as a polyphenylene isophthalamide, a polyhexamethylene terephthalamide, or a poly(p-phenylene terephthalamide)), a polyolefinic fiber (e.g., a poly$C_{2-4}$ olefinic fiber such as a polyethylene or a polypropylene), an acrylic fiber (e.g., an acrylonitrile-series fiber having an acrylonitrile unit such as an acrylonitrile-vinyl chloride copolymer), a polyvinyl-series fiber (e.g., a polyvinyl acetal-series fiber), a polyvinyl chloride-series fiber (e.g., a fiber comprising a polyvinyl chloride, a fiber comprising a vinyl chloride-vinyl acetate copolymer, and a fiber comprising a vinyl chloride-acrylonitrile copolymer), a polyvinylidene chloride-series fiber (e.g., a fiber comprising a vinylidene chloride-vinyl chloride copolymer and a fiber comprising a vinylidene chloride-vinyl acetate copolymer), a poly(p-phenylenebenzobisoxazole) fiber, a poly(phenylene sulfide) fiber, and a cellulose-series fiber (e.g., a rayon fiber and an acetate fiber). These non thermal adhesive fibers under moisture may be used singly or in combination.

These non thermal adhesive fibers under moisture can be selected according to the applications and used therefor. For an application which requires mechanical properties (e.g., hardness and bending strength) rather than lightness in weight, a hydrophilic fiber having a high hygroscopicity, for example, a polyvinyl-series fiber and a cellulose-series fiber, particularly, a cellulose-series fiber is preferably used. The cellulose-series fiber may include, for example, a natural fiber (e.g., a cotton, a wool, a silk, and a linen or flax or ramie), a semi-synthetic fiber (e.g., an acetate fiber such as a triacetate fiber), and a regenerated fiber (e.g., a rayon, a polynosic, a cupra, and a reyocell (e.g., registered trademark: "Tencel")). Among these cellulose-series fibers, for example, a semi-synthetic fiber (such as a rayon) can be preferably used in combination with the thermal adhesive fiber under moisture comprising an ethylene-vinyl alcohol copolymer since the semi-synthetic fiber has an affinity for the thermal adhesive fiber under moisture. The fibers of such a combination use reduce the distance or space formed therebetween due to the affinity to improve the bond thereof, thereby producing a shaped product having mechanical properties and density which are relatively high for the shaped product of the present invention.

On the other hand, for producing a shaped product for an application requiring lightness in weight, a hydrophobic fiber having a hygroscopicity, for example, a polyolefinic fiber, a polyester-series fiber, a polyamide-series fiber, particularly, a polyester-series fiber having properties in a well-balanced manner (e.g., a polyethylene terephthalate fiber) is preferably used. Such a hydrophobic fiber is used in combination with the thermal adhesive fiber under moisture comprising an ethylene-vinyl alcohol copolymer to produce a shaped product having an excellent lightness in weight.

The ranges of the average fiber length and the average fineness of the non thermal adhesive fiber under moisture are the same as those of the thermal adhesive fiber under moisture.

The proportion (mass ratio) of the thermal adhesive fiber under moisture relative to the non thermal adhesive fiber under moisture can be selected from the range (the thermal adhesive fiber under moisture the non thermal adhesive fiber under moisture) of 10/90 to 100/0 (for example, 20/80 to 100/0), according to the applications of the shaped product. For producing a hard shaped product, the proportion of the thermal adhesive fiber under moisture is preferably large. For example, the proportion (mass ratio) of the both fibers (the thermal adhesive fiber under moisture/the non thermal adhesive fiber under moisture) is about 80/20 to 100/0, preferably about 90/10 to 100/0, and more preferably about 95/5 to 100/0. A proportion of the thermal adhesive fiber under moisture within the above-mentioned range provides a shaped product having a high hardness of the compression and a high bending behavior. For producing a shaped product having the advantages of the non thermal adhesive fiber under moisture, the proportion (mass ratio) of the both fibers (the thermal adhesive fiber under moisture/the non thermal adhesive fiber under moisture) is about 20/80 to 99/1, preferably about 30/70 to 90/10, and more preferably about 40/60 to 80/20.

The shaped product (or fiber) of the present invention may further contain a conventional additive, for example, a stabilizer (e.g., a heat stabilizer such as a copper compound, an ultraviolet absorber, a light stabilizer, or an antioxidant), a particulate (or fine particle), a coloring agent, an antistatic agent, a flame-retardant, a plasticizer, a lubricant, and a crystallization speed retardant. These additives may be used singly or in combination. The additive may adhere on a surface of the shaped product or may be contained in the fiber.

Incidentally, adding a flame-retardant to the shaped product (or fiber) of the present invention is advantageous when the shaped product (or fiber) is used for the application requiring flame retardancy, e.g., a material for an automobile interior or an inside wall material for an aircraft which is mentioned later. The flame-retardant which may be used includes a conventional inorganic flame-retardant and organic flame-retardant. A halogen-containing flame retardant and a phosphorus-containing flame retardant, which are in widespread use and have high flame retardancy, may also be used as the flame-retardant for the shaped product (or fiber). However, the halogen-containing flame retardant and phosphorus-containing flame retardant have the following problems: the incineration of the shaped product containing the halogen-containing flame retardant generates a halogen gas, which consequently causes acid rain; and the hydrolysis of the phosphorus-containing of the shaped product causes the discharge of phosphorus compounds, which leads to the eutrophication of lakes and mashes. Therefore, in the present invention, a boron-containing flame retardant and/or a silicon-containing flame retardant, which dose not cause such problems, is preferably used to impart a high flame retardancy to the shaped product.

The boron-containing flame retardant may include, for example, a boric acid (e.g., orthoboric acid and metaboric acid), a salt of a boric acid [e.g., a salt of a boric acid and an alkali metal such as sodium tetraborate, a salt of a boric acid and an alkaline earth metal such as barium metaborate, and a salt of a boric acid and a transition metal such as zinc borate], and condensed boric acid (or a salt thereof) (e.g., pyroboric acid, tetraboric acid, pentaboric acid, octaboric acid, and a metal salt thereof). These boron-containing flame retardants may be a hydrate compound (e.g., a borax such as sodium tetraborate hydrate). These boron-containing flame retardants may be used singly or in combination.

The silicon-containing flame retardant may include, for example, a silicone compound such as a polyorganosiloxane, an oxide such as a silica or a colloidal silica, and a metal silicate such as calcium silicate, aluminum silicate, magnesium silicate, or magnesium aluminosilicate.

These flame-retardants may be used singly or in combination. Among these flame-retardants, the boron-containing flame retardant such as a boric acid or a borax is preferably used as a main component. In particular, the boric acid and the borax are preferably used in combination. The proportion (mass ratio) of the both components (the boric acid/the borax) is about 90/10 to 10/90 and preferably about 60/40 to 30/70. The boric acid and the borax may be used in the form of an aqueous solution for a process for imparting flame retardancy to the shaped product. For example, about 10 to 35 parts by mass of the boric acid and about 15 to 45 parts by mass of the borax may be added to 100 parts by mass of water and dissolved to prepare an aqueous solution.

The proportion of the flame-retardant is selected according to the applications of the shaped product. The proportion of the flame-retardant relative to the whole mass of the shaped product is, for example, about 1 to 300% by mass, preferably about 5 to 200% by mass, and more preferably about 10 to 150% by mass.

The process for imparting flame retardancy to the shaped product may include a process, like a conventional dip-nip process, comprising impregnating or spraying the shaped product of the present invention with an aqueous solution containing the flame-retardant and drying the obtained shaped product, a process comprising kneading the resin and the flame-retardant by a biaxial extruder to extrude a fiber, spinning the obtained fiber, and using the obtained fiber to produce the shaped product, or the like.

(Properties of Shaped Product)

The shaped product of the present invention has a fiber aggregate nonwoven structure formed by a web comprising the fiber. The form of the shaped product is selected according to the applications and usually a sheet- or plate-like shape.

Moreover, in order to produce the shaped product having an excellent balance of lightness in weight and air-permeability together with a high hardness of the compression and bending endurance, it is necessary to adjust the arrangement and bonding state of the fiber constituting the above-mentioned web to specific ones. That is, it is preferable that the fibers constituting the fiber web be distributed or arranged to cross each other with putting the fiber length direction in a direction approximately parallel to the surface of the fiber web (nonwoven fiber). Furthermore, the fibers in the shaped product of the present invention are melt-bonded at each intersection point thereof. In particular, in the shaped product requiring high hardness and strength, a few or tens of the fibers approximately parallel to each other may be melt-bonded to form a melt-bonded bundle of the fibers in addition to the fibers melt-bonded at the intersection points thereof. The formation of the melt-bond of the fibers at spaced and discrete distance (such as the melt-bond of the mono-fibers at the intersection points thereof, the melt-bond of the melt-bonded bundles of the fibers, or the melt-bond of the mono-fiber to the melt-bonded bundles of the fibers) leads to a structure which is like a jungle-gym (or a three-dimensional crosslinking) of the fibers, thereby providing a shaped product having a desired bending behavior and hardness of the compression. Such a structure is a net-like structure in which the fibers (e.g., the mono-fibers, the melt-bonded bundle of the fibers, and a combination thereof) are bonded at the intersection points thereof or a structure in which the fibers are bonded at the intersection points to fix the other fibers adjacent thereto on the fibers. A preferred mode of the shaped product of the present invention is an approximately uniform distribution of the structure in the direction parallel to the surface of the fiber web (surface direction) and in the thickness direction of the fiber web.

The term "(the fiber) being distributed or arranged to cross each other with putting the fiber length direction in a direction approximately parallel to the surface of the fiber web" means a state of the fibers in the fiber web which is free from the high frequent distribution of part or area having a large number of the fibers with being the fiber length direction parallel to the thickness direction. More specifically, based on the observation of any area of the cross section of the fiber web of the shaped product by a microscope, the presence rate (the proportion of the number of fibers) of the fiber whose fiber length direction is approximately parallel to the thickness direction without bending or break, is not more than 10% (particularly not more than 5%) relative to the total number of the fibers in the cross section. Incidentally, in the observation, such a fiber has a length of not less than 30% of the thickness of the fiber web, across the cross section.

Distributing or arranging the fiber with putting the fiber length direction in a direction approximately parallel to the surface of the fiber web avoids or eliminates a large amount (or a lump) of the fibers with being the fiber length direction approximately parallel to the thickness direction (in a direction perpendicular to the web surface), which disturbs the arrangement of the fibers adjacent thereto. The disorder causes the formation of excessively large voids between the nonwoven fibers, which decreases the bending strength or the hardness of the compression of the shaped product. It is thus preferable to prevent such a void formation as much as possible. For that reason, it is desirable that the fibers be preferably arranged in the direction approximately parallel to the fiber web surface as much as possible.

Incidentally, the webs are entangled (or interlaced) with each other by a mean such as a needle-punching to facilitate the production of a high-density shaped product. Moreover, entangling the fibers with each other before thermal bonding under moisture preserves the shape or form of the fibers, whereby the production of a thick or bulky shaped product is facilitated and has an advantage in manufacturing efficiency. However, entangling the fibers by a needle-punching is not suitable for arranging the fiber with putting the fiber length direction in a direction approximately parallel to the fiber web surface. Furthermore, it is difficult to produce a shaped product having lightness in weight and a low density since the density of the shaped product is increased by entangling the fibers. Therefore, in order to arrange the fibers with putting the fiber direction in a direction approximately parallel to the web surface and produce a shaped product having lightness in weight, it is preferable that the degree of entanglement of the fibers be reduced or the fibers be not entangled.

In particular, when applying (placing) a load on the sheet- or plate-like shaped product of the present invention having a part or area having a large void, in a thickness direction, the part is destroyed by the applied load, and the surface of the shaped product easily deform. Moreover, when the load is applied on the whole surface of the shaped product, the thickness of the shaped product is easily reduced. A shaped product filled with a resin and having no voids eliminates the problem mentioned above. Although such a shaped product has a low air-permeability, the shaped product cannot afford breaking resistance (folding endurance) at bending, and lightness in weight.

Meanwhile, a shaped product comprising a finer fiber, being filled tightly therewith, reduces a deformation in the thickness direction by the applied load. However, when only the finer fibers are used to produce a shaped product being light and air-permeable, the bending stress of the shaped product is degreased since the finer fibers has a low rigidity. In order to produce a shaped product comprising the finer fiber and having bending stress, it is necessary to add a fiber having a diameter larger than the finer fiber to the finer fiber. However, only mixing (or adding) the thick fibers with (to) the fiber web is not enough to overcome the problem since large voids are formed around the intersection points of the thick fibers, and the obtained shaped product is readily deformed in the thickness direction.

Accordingly, the lightness in weight of the shaped product of the present invention is attained by the following manner: arranging the fibers (or allowing the fiber length direction to point various directions randomly) to intersect with each other, with being the fiber length direction approximately parallel to the web surface; and bonding the fibers at the intersection point thereof to form small voids between the fibers. Moreover, owing to the continuous formation of such a structure formed by the fibers throughout the shaped product, the shaped product of the present invention has an adequate air-permeability and hardness of the compression. In particular, in part or area in which the adjacent fibers do not intersect with each other but are approximately parallel to each other, the bundles of the fibers are melt-bonded in the fiber length direction. A shaped product having the melt-bonded bundles of the fibers in addition to the mono-fibers melt-bonded at the intersection points often attains a higher bending stress more than a shaped product having the mono-fibers melt-bonded at the intersection points alone. When a shaped product having a high hardness and strength is desired, it is preferable that the shaped product have the mono-fibers melt-bonded at the intersection points and, between the intersection points of the mono-fibers melt-bonded, a few of the melt-bonded bundles of the fibers adjacent to each other in an approximately parallel direction. Such a structure can be revealed by the observation of the present state (or appearance) of the mono-fibers in the cross section of the shaped product.

Moreover, in the shaped product of the present invention, the thermal adhesive fibers under moisture are melted to bond the fibers constituting the fiber aggregate nonwoven structure, and the bonded fiber ratio of is not more than 85% (e.g., about 1 to 85%), preferably about 3 to 70%, and more preferably about 5 to 60% (particularly about 10 to 35%). The bonded fiber ratio can be determined by a method in Example 1 described later. The bonded fiber ratio means the proportion of the number of the cross sections of two or more fibers bonded relative to the total number of the cross sections of fibers in the cross section of the fiber aggregate. Accordingly, the low bonded fiber ratio means a low proportion of the melt-bond of a plurality of fibers (or a low proportion of the fibers melt-bonded to form bundles).

Moreover, in the present invention, the fibers constituting the fiber aggregate nonwoven structure are bonded at the intersection points thereof. In order to produce a shaped product having a high bending stress with the number of bonded points as less as possible, it is preferable that the bonded points uniformly distribute from the surface, via inside (middle), to the backside of the shaped product in the thickness direction. A concentration of the bonded points in the surface or inside not only tends to fail to provide a shaped product having a sufficient bending stress but also lowers the form stability at a part having a small number of the bonded points.

Accordingly, it is preferable that the bonded fiber ratio in each of three areas in the cross section of the shaped product be within the above-mentioned range. The above-mentioned three areas are obtained by cutting the shaped product across the thickness direction and dividing the obtained cross section equally into three in a direction perpendicular to the thickness direction. In addition, the difference between the maximum and minimum of bonded fiber ratios of in each of the three areas is not more than 20% (e.g., about 0.1 to 20%), preferably not more than 15% (e.g., about 0.5 to 15%), and more preferably not more than 10% (e.g., about 1 to 10%). Owing to such a uniform distribution of the bonded fiber ratio in the thickness direction, the shaped product of the present invention has an excellent hardness or bending strength, folding endurance or toughness.

Incidentally, in the present invention, the term "area obtained by cutting the shaped product across the thickness direction and dividing the obtained cross section equally into three in a direction perpendicular to the thickness direction" means each area obtained by cutting the plate-like shaped product equally in an orthogonal direction to (perpendicular to) the thickness direction into three slices.

As mentioned above, in the shaped product of the present invention, the melt-bond of the fibers by the thermal adhesive fiber under moisture are uniformly distributed to form points in which the fibers are bonded (or spot bonds) at a close distance. The distance between the points is so close (e.g., several ten to several hundred μm) that a dense network structure is formed throughout the shaped product. Presumably, such a structure provides a shaped product of the present invention having a high folding endurance or toughness due to the distribution of an external force by each melt-bonded point finely dispersed and a high conformability to the strain. On the other hand, a conventional porous shaped product or a foamed shaped product has cell-like voids which are divided by the continuous interfaces. Presumably, when an external force is applied on the conventional shaped product, a larger area formed by the interface of the cell-like voids, compared with the shaped product of the present invention, directly receives the force without distributing the force. Therefore the conventional shaped product is easily deformed and has a lower folding endurance and toughness.

The presence frequency (number) of the mono-fiber (the end face of the mono-fiber) in the cross section in the thickness direction in the shaped product of the prevent invention is not particularly limited to a specific one. For example, the presence frequency of the mono-fiber in 1 $mm^2$ selected arbitrarily in the cross section may be not less than 100/$mm^2$ (e.g., about 100 to 300/$mm^2$). In particular, for the shaped product requiring mechanical property rather than light-weight property, the presence frequency of the mono-fiber may be, for example, not more than 100/$mm^2$, preferably not more than 60/$mm^2$ (e.g., about 1 to 60/$mm^2$), and more preferably not more than 25/$mm^2$ (e.g., about 3 to 25/$mm^2$). An excessively high presence frequency of the mono-fiber means a less formation of the melt-bond of the fibers, whereby the shaped product has a lower strength. Incidentally, the presence frequency of the mono-fiber of more than 100/$mm^2$ means a less formation of the melt-bond of the bundles of the fibers, whereby the shaped product has a low bending strength. Moreover, in a plate-like shaped product, it is preferable that the melt-bonded bundles of the fibers hardly aggregate in the thickness direction of the shaped product and widely distribute in a direction parallel to the surface direction (lengthwise direction or width direction of the surface).

Incidentally, in the present invention, the presence frequency of the mono-fiber is determined by the following manner. That is, an area (about 1 $mm^2$) is selected from an electron micrograph of the cross section of the shaped product, which is obtained by a scanning electron microscope (SEM), and observed to count the number of the cross sections of the mono-fibers. Some areas arbitrarily selected from the electron micrograph (e.g., 10 areas randomly selected therefrom) are observed by the same manner. The presence frequency of the mono-fiber is represented by the average number of the cross sections of the mono-fibers per 1 $mm^2$. In the observation, the total number of the fibers which have a cross-section of a mono-fiber in the cross section of the shaped product is counted. That is, the fiber which is counted as the mono-fiber in the observation includes a fiber which is melt-bonded to other fibers but has a mono-fiber cross section in the electron micrograph of the cross section of the shaped product, in addition to the fiber which is the complete mono-fiber.

In the shaped product, preventing the fiber length direction of the thermal adhesive fiber under moisture from being parallel to the thickness of the shaped product (preventing the fiber from penetrating through the shaped product in the thickness direction), whereby a defect such as fall out of the fiber is prevented. The production process comprising arranging the thermal adhesive fiber under moisture in the above-mentioned manner is not particularly limited to a specific one. An easy and sure mean for the preferred fiber arrangement is laminating a plurality of the shaped products, each obtained by entangling the thermal adhesive fibers under moisture, and subjecting the obtained laminate to a thermal bonding under moisture. Moreover, the adjustment of the relation between the fiber length and the thickness of the shaped product reduces the number of the fibers with being the fiber length direction parallel to the thickness direction. Accordingly, the ratio of the thickness of the shaped product relative to the fiber length is not less than 10% (e.g., about 10 to 1000%), preferably not less than 40% (e.g., about 40 to 800%), more preferably not less than 60% (e.g., about 60 to 700%), and particularly not less than 100% (e.g., 100 to 600%). The ratio between the thickness of the shaped product and the fiber length within the above-mentioned range prevents the defect of the shaped product such as a fall out of the fiber, without deteriorating the mechanical strength of the shaped product such as a bending stress.

As mentioned above, the density or mechanical properties of the shaped product of the present invention is influenced by the proportion or presence state of the melt-bonded bundle of the fibers. The bonded fiber ratio which means the degree of melt-bond of the fibers is easily determined by the following manner: taking a macrophotography of the cross section of the shaped product by using the SEM; and counting the number of the cross section of the melt-bonded fibers in a predetermined area of the macrophotograph. However, particularly in the dense aggregation of the fibers, it is difficult to count the fibers individually in the melt-bonded bundle of the fibers in which fibers form a bundle with each other or intersect with each other. In this case, the determination of the bonded fiber ratio is as follows, which is obtained by bonding the fibers with a sheath-core form conjugated fiber comprising a sheath part comprising the thermal adhesive fiber under moisture and a core part comprising a fiber formable polymer: observing the cross section of the shaped product; loosing the melt-bonded fibers by a mean such as melting or washing out (or off) the thermal adhesive resin under moisture; observing the cross section again; and comparing the observations with each other. On the other hand, in the present invention, the area ratio of the total cross section of the fiber and the cross section of the fiber bundle relative to the cross section of the shaped product after the production thereof (the cross section in the thickness direction) can be used as an index representing the degree of melt-bond of the fibers. That is, the area ratio is the fiber-occupancy ratio. The fiber-occupancy ratio in the thickness direction of the shaped product is, for example, about 20 to 80%, preferably about 20 to 60%, and more preferably about 30 to 50%. An excessively small fiber-occupancy ratio provides a large number of voids, whereby it is difficult to provide a shaped product having a desired hardness of the compression and bending stress. On the other hand, an excessively large fiber-occupancy ratio provides a shaped product having hardness of the compression and bending stress, but the shaped product is very heavy and tends to have a low air-permeability.

It is desirable, even in the form of a plate (a board), that the shaped product of the present invention (particularly, the shaped product having the melt-bonded bundles of the fibers and a presence frequency of the mono-fiber of not more than 100/$mm^2$) have hardness of the compression which prevents a dent or deformation by applying a load thereon. An index of such a hardness is, for example, a hardness of not less than A50, preferably not less than A60, and more preferably not less than A70, determined by A type durometer hardness test (the test in accordance with JIS K6253 "rubber, vulcanized or thermoplastic-determination of hardness"). An excessively small hardness allows the shaped product to deform easily by the applied load on the surface thereof.

In order to impart an excellent balance of high bending strength, hardness of the compression, lightness in weight, and air-permeability to such a shaped product having the melt-bonded bundles of the fibers, it is preferable that the presence frequency of the melt-bonded bundle of the fibers be low and each fiber (each bundle of the fibers and/or each mono-fiber) be much frequently bonded to other fibers at the intersection point thereof. However, an excessively high bonded fiber ratio produces the points excessively close to each other, at which the fibers or bundles are bonded, whereby the shaped product has a low flexibility and it is difficult to cancel the strain due to an external force. For that reason, the bonded fiber ratio of the shaped product of the present invention is necessary to be not more than 85%. Preventing an excessive high bonded fiber ratio provides pathways of air formed by small voids adjacent to each other in the shaped product, whereby the lightness in weight and air-permeability are improved. Accordingly, in order to impart a high hardness of the compression and air-permeability to a shaped product having the number of the contact points of the fibers as less as possible, it is preferable that the bonded fiber ratio be uniformly distributed from the surface through the inside (middle) to the backside of the shaped product in the thickness direction. The concentration of the bonding point at the surface or inside of the shaped product makes it difficult to provide a shaped product having air-permeability, besides the above-mentioned bending stress or form stability.

Accordingly, in the shaped product of the present invention, the fiber-occupancy ratio in each of three areas obtained by dividing the shaped product into three equally with respect to the thickness direction is preferably within the above-mentioned range. Moreover, the difference between the maximum and minimum of occupancies with the fiber in each of three areas is not more than 20% (e.g., 0.1 to 20%), preferably not more than 15% (e.g., 0.5 to 15%), and more preferably not more than 10% (e.g., 1 to 10%). In the present invention, the uniform distribution of the fiber-occupancy ratio in the thickness direction provides a shaped product having an excellent bending strength or folding endurance or toughness. The fiber-occupancy ratio in the present invention is determined by the method in Examples described later.

One of the features of the shaped product of the present invention is that the shaped product exhibits the bending behavior which a conventional wood fiber board material does not achieve (or afford). In the present invention, in accordance with JIS K7017 "fiber-reinforced plastic composites-determination of flexural properties", a sample is gradually bent to measure a generated repulsive (repelling) power, and let the obtained maximum stress (peak stress) be the bending stress, which is used as an index representing the bending behavior. That is, the greater bending stress the shaped product has, the harder the shaped product is. Furthermore, the greater the bending deflection (bending displacement) to break the measuring object is required, the more flexible the shaped product is.

The maximum bending stress of the shaped product of the present invention is not less than 0.05 MPa (e.g., about 0.05 to 100 MPa) in at least one direction (preferably, in all directions). The maximum bending stress may preferably be about 0.1 to 30 MPa and more preferably about 0.2 to 20 MPa. Moreover, in the shaped product having a high bending stress e.g., in a shaped product containing the fibers melt-bond to form a bundle (a plurality of fibers which form a bundle and are melt-bonded), the maximum bending stress may be not less than 2 MPa, preferably about 5 to 100 MPa, and more preferably about 10 to 60 MPa. A shaped product having an excessively small maximum bending stress readily breaks by its own weight or by only a slight amount of the load applied thereon when the shaped product is used as a board material. Moreover, a shaped product having an excessively large maximum bending stress is very hard. Such a shaped product readily breaks when the shaped product is kept bending even after exceeding the peak of the stress. Incidentally, in order to impart a hardness of more than 100 MPa to a shaped product, it is necessary that the density of the shaped product be increased. In such a case, it is difficult to impart lightness in weight to the shaped product.

The correlation between the bending deflection and the bending stress generated by the bending deflection is as follows: at first, the stress is increased as the bending deflection is increased (e.g., an increase in the stress is an approximately linear); and the stress starts to decrease gradually after the bending deflection of a measuring sample is increased to its specific bending deflection. That is, the graph obtained by plotting the bending deflection and the stress shows a correlation describing a convex parabola. The shaped product of the present invention does not show an abrupt decrease in the stress when the shaped product is kept bending even after exceeding the maximum bending stress (the peak of the bending stress). In other words, the shaped product shows "tenacity (or toughness)", which is also one of features of the shaped product of the present invention. In the present invention, such a "tenacity" is represented by an index which uses a bending stress remaining at a bending deflection after exceeding a bending deflection at the peak bending stress. That is, the shaped product of the present invention may maintain at least a stress of not less than ⅕ (e.g., ⅕ to 1) of the maximum bending stress at 1.5 times as large as the bending deflection at the maximum bending stress (hereinafter, sometimes referred as to "stress at 1.5 times bending deflection"). The shaped product may maintain a stress at 1.5 times bending deflection of, for example, not less than ⅓ (e.g., ⅓ to 9/10) of the maximum bending stress, preferably not less than ⅖ (e.g., ⅖ to 9/10) of the maximum bending stress, and more preferably not less than ⅗ (e.g., ⅗ to 9/10) of the maximum bending stress. In addition, the shaped product may maintain a stress at 2 times bending deflection of, for example, not less than 1/10 (e.g., 1/10 to 1) of the maximum bending stress, preferably not less than 3/10 (e.g., 3/10 to 9/10) of the maximum bending stress, and more preferably not less than 5/10 (e.g., 5/10 to 9/10) of the maximum bending stress.

The shaped product of the present invention has an excellent lightness in weight owing to the voids formed between the fibers. Moreover, since these voids are not completely divided by the fibers, the shaped product (structure) has an air-permeability unlike the voids which are separated from each other in a foam resin such as a sponge. Such a structure of the shaped product of the present invention is difficult for a conventional hardening process to form, such as a resin impregnation process or a process for forming a film-like structure by bonding fibers in a surface part firmly.

That is, the shaped product of the present invention has a low density, specifically, the apparent density of the shaped product is, for example, about 0.05 to 0.7 g/cm$^3$. In particular, the apparent density of the shaped product for an application requiring lightness in weight is, for example, about 0.05 to 0.5 g/cm$^3$, preferably about 0.08 to 0.4 g/cm$^3$, and more preferably about 0.1 to 0.35 g/cm$^3$. The apparent density of the shaped product for an application requiring hardness rather than lightness in weight may be, about 0.2 to 0.7 g/cm$^3$, preferably about 0.25 to 0.65 g/cm$^3$, and more preferably about 0.3 to 0.6 g/cm$^3$. An excessively low apparent density provides a shaped product having lightness in weight, whereby the bending endurance and hardness of the compression of the shaped product are decreased. On the other hand, an excessively high apparent density provides a shaped product having hardness, whereby the shaped product becomes heavy. Incidentally, in a shaped product having a lower the density, the fibers are entangled with each other to bond only at intersectional points thereof, whereby the structure of the shaped product is more resemble to a conventional fiber aggregate nonwoven structure. On the other hand, in a shaped product having a higher density, the fibers are melt-bonded, forming the bundles of the fibers. Such melt-bonded bundles of the fibers form the voids having a cell-like shape, whereby the structure of the shaped product is more resemble to a structure of a porous product.

The basis weight of the shaped product of the present invention can be selected from the range, for example, about 50 to 10000 g/m$^2$, preferably about 150 to 8000 g/m$^2$, and more preferably about 300 to 6000 g/m$^2$. The basis weight of the shaped product for an application requiring hardness rather than lightness in weight may be, for example, about 1000 to 10000 g/m$^2$, preferably about 1500 to 8000 g/m$^2$, and more preferably about 2000 to 6000 g/m$^2$. An excessively small basis weight decreases the hardness of the shaped product. On the other hand, an excessively large basis weight significantly increases the thickness of the web. In a moist-thermal (heat) process, a high-temperature water vapor fails to enter the inside of the web having an excessively large basis weight, and it is difficult to form a structure having a uniform distribution of the melt-bond of the fibers in the thickness direction.

The thickness of the plate- or sheet-like shaped product of the present invention is not particularly limited to a specific one and can be selected from the range of about 1 to 100 mm, for example, and may be about 3 to 100 mm, preferably about 3 to 50 mm, and more preferably about 5 to 50 mm (particularly about 5 to 30 mm). A shaped product having an excessively small thickness tends to fail to afford hardness. On the other hand, a shaped product having an excessively large thickness is heavy and difficult to handle as a sheet.

Owing the fiber aggregate structure, the shaped product of the present invention has a high air-permeability. The air-permeability of the shaped product of the present invention measured by a Fragzier tester method is not less than 0.1 cm$^3$/cm$^2$/second (e.g., about 0.1 to 300 cm$^3$/cm$^2$/second), preferably about 0.5 to 250 cm$^3$/cm$^2$/second (e.g., about 1 to 250 cm$^3$/cm$^2$/second), more preferably about 5 to 200 cm$^3$/cm$^2$/second, and usually, about 1 to 100 cm$^3$/cm$^2$/second. An excessively small air-permeability does not allow air to pass through the shaped product spontaneously, whereby an external pressure is needed to pass air therethrough. On the other hand, a shaped product having an excessively large air-permeability has large voids. Such a shaped product has a higher air-permeability but a low bending stress due to the large voids.

Owing to the fiber aggregate nonwoven structure of the shaped product of the present invention, the thermal insulation property of the shaped product is also high. The thermal conductivity of the shaped product is low, e.g., not more than 0.1 W/m·K, and is, e.g., about 0.03 to 0.1 W/m·K, and preferably about 0.05 to 0.08 W/m·K.

(Production Process of Shaped Product)

In the process for producing the shaped product of the present invention, firstly, a web is formed from the fiber comprising the thermal adhesive fiber under moisture. The web-forming process which may be used includes a conventional process, e.g., a direct process such as a span bond process or a melt-blow process, a carding process using a melt-blow fiber or a staple fiber, and a dry process such as air-laid process. Among these processes, a carding process using a melt-blow fiber or a staple fiber, particularly, a carding process using a staple fiber is commonly used. The web obtained by using the staple fiber may include, e.g., a random web, a semi-random web, a parallel web, and a cross-wrap web. Among these webs, a semi-random web or a parallel web is preferable to increase the proportion of the melt-bonded bundle of the fibers of the web.

The obtained fiber web is then conveyed (or carried) to the next step by a belt conveyor and is exposed to a flow of a superheated water vapor or a high-temperature vapor (a high-pressure steam) to produce a shaped product having a fiber aggregate nonwoven structure of the present invention. That is, while the fiber web on the conveyer is passing through a flow of a high-speed and high-temperature water vapor sprayed (or applied) from a nozzle of the vapor spraying apparatus, the fibers of the web are bond three-dimensionally by the high-temperature water vapor sprayed thereto.

The belt conveyor to be used is not particularly limited to a specific one as long as the conveyor can principally carry the fiber web in order to subject the web to the high-temperature water vapor treatment while compressing the web. The preferably used one includes an endless conveyer. Incidentally, a common single belt conveyer may be used, and according to need, the two single belt conveyers may be used in combination to carry the fiber web with holding the web between belts of these conveyors. Carrying the web by two conveyers in the above-mentioned manner prevents the deformation of the web being carried due to an external force such as water used for the treatment or a high-temperature water vapor (steam), or a vibration of the conveyer at the web treatment. Moreover, the density or thickness of the fiber aggregate after the treatment can be controlled by adjusting the distance between the belts.

In the combination use of the two belt conveyers, a first conveyor may have a first vapor spraying apparatus for supplying the web with the vapor disposed behind the conveying surface thereof to supply the web with the vapor through the conveyor net, and a second conveyor may have a first suction box disposed behind the conveying surface thereof, being opposite to the first vapor spraying apparatus, to remove a surplus vapor which has passed through the web. In addition, in order to treat the both surfaces of the web with the vapor at once, the first conveyer may further have a second suction box disposed behind the conveying surface, being distanced from the first vapor spraying apparatus in the traveling direction of the web, and the second conveyer may further has a second vapor spraying apparatus disposed behind the conveying surface, being distanced from the first suction box disposed in the web traveling direction and opposite to the second suction box. An alternative process for subjecting the both surfaces of the fiber web to the vapor treatment without the second vapor spraying apparatus and the second suction box in the web traveling direction is as follows: passing the fiber web through the clearance between the first vapor spraying apparatus and the first suction box to subject a surface of the web to the vapor treatment; reversing the obtained fiber web; and passing the reversed fiber web through therebetween to subject another surface of the web to the vapor treatment.

The endless belt to be used for the conveyer is not particularly limited to a specific one as long as the belt does not hinder the transport of the web or the high-temperature vapor treatment. However, since the shape (or pattern) of the surface of the belt is sometimes transcribed on the surface of the fiber web depending on the condition of the high-temperature vapor treatment, it is preferable that the belt be selected according to the application. In particular, for producing a shaped product having a flat surface, a net having a fine mesh is used as the belt. Incidentally, the upper limit of the mesh count of the net is about 90 mesh, and the net having a mesh count more then above-mentioned number has a low air-permeability and makes it difficult to allow the vapor to pass therethrough. The preferred material of the mesh belt in terms of heat resistance for the vapor treatment or the like is, for example, a metal, a polyester-series resin treated for heat resistance, and a heat resistant resin such as a polyphenylenesulfide-series resin, a polyallylate-series resin (a fully aromatic-series polyester-series resin) or an aromatic polyamide-series resin.

The high-temperature water vapor sprayed from the vapor spraying apparatus is an air (or gaseous) flow and enters the inside of the web being treated without moving the fibers thereof greatly, unlike a hydroentangling or a needle-punching. Presumably, this vapor entering effect and moisture-heat effect bring the surface of each fiber of the web into a moisture-heat state with the vapor flow to form a uniform melt-bond of the fibers. Moreover, the time of the treatment which is conducted under the high-speed air flow is so short that the heat is conducted just to the surface of the fiber adequately but not to the inside thereof adequately by completion of the treatment. For that reason, the treatment hardly tends to cause a deformation such as a crush of the whole fiber web to be treated or decrease in the thickness of the fiber web by the pressure or heat of the high-temperature water vapor. As a result, the almost uniform distribution of the bond of the fibers due to moist and thermal (heat) with being the fiber length direction approximately parallel to the surface and in the thickness direction of the shaped product is achieved without a huge deformation of the fiber web.

In addition, for producing a shaped product having a high hardness of the compression or bending strength, it is important that before and during the treatment in which the web is supplied with the high-temperature water vapor, the web to be treated be compressed for adjusting an objective apparent density (e.g., about 0.2 to 0.7 g/cm$^3$), and the compressed fiber web be exposed to the high-temperature vapor with keeping the obtained apparent density. In particular, for producing a shaped product having a relatively high density, it is necessary that before and during the treatment, the fiber web to be treated be compressed by an adequate pressure and then the compressed fiber web be treated with a high-temperature water vapor. Moreover, manipulating a clearance between two rollers or conveyers can adjust the thickness or density of the shaped product to an objective one. In case of the conveyers, since the conveyers are not suitable for compressing the web at once, it is preferable that the conveyers be strained to obtain a tense as high as possible, and the clearance therebetween be narrowed gradually in the traveling direction of the fiber web before the vapor treatment starts. Moreover, the adjustment of the steam pressure or processing speed produces a shaped product having a desired bending endurance, hardness of the compression, lightness in weight, or air-permeability.

In the above-mentioned vapor treatment, in order to enhance the hardness of the web, a stainless-steel plate is disposed behind the conveying surface of the endless belt, being opposite to the nozzle disposed behind the conveying surface of another endless belt from the web, to form a structure preventing the vapor from leaking or flowing over. In such a structure, the vapor which has once passed though the web as an object to be treated is returned to the web by the plate deposed behind the endless belt, whereby the heat retained by the returned vapor allows the fibers of the web to bond to each other firmly. On the other hand, for achieving a moderate bond of the fibers, a suction box is disposed behind conveying surface of the endless belt, instead of the plate, to remove a surplus water vapor.

For spraying the high-temperature water vapor, a plate or die having a plurality of predetermined orifices arranged in a line in a width direction thereof is used as the nozzle, and the plate or die is disposed to arrange the orifices in the width direction of the web to be conveyed. The plate or die may have at least one orifice line or a plurality of orifice lines, being parallel to each other. Moreover, it is possible that a plurality of nozzle dies, each having one orifice line, be disposed being parallel to each other.

The thickness of a plate nozzle having a plurality of orifices formed thereon may be about 0.5 to 1 mm. The diameter of the orifice or the pitch between the orifices is not particularly limited to a specific one as long as the diameter or pitch thereof can present the objective bond of the fibers. The diameter of the orifice is usually, about 0.05 to 2 mm, preferably about 0.1 to 1 mm, and more preferably about 0.2 to 0.5 mm. The pitch between the orifices is, usually, about 0.5 to 3 mm, preferably about 1 to 2.5 mm, and more preferably about 1 to 1.5 mm. An excessively small diameter of the orifice tends to cause difficulties, for example, a difficulty in equipment processability due to a low accuracy of processability for the nozzle and a difficulty in operation due to a frequent plugging of the orifice. An excessively large diameter of the orifice decreases the power for jetting with vapor of the nozzle. On the other hand, an excessively small pitch between the orifices makes the distance between nozzle holes so close that the strength of the nozzle is decreased. An excessively large pitch between the orifices causes a possible insufficient contact of a high-temperature water vapor with the web, whereby the strength of the obtained web is low.

The high-temperature water vapor is not particularly limited to a specific one as long as an objective bonding state of the fibers can be achieved. The pressure of the high-temperature water vapor is, according to the quality of material or form of the fiber to be used, for example, about 0.1 to 2 MPa, preferably about 0.2 to 1.5 MPa, and more preferably about 0.3 to 1 MPa. An excessively high or strong pressure of the vapor disturbs the arrangement of the fibers constituting the web, whereby the fabric appearance or texture of the web is destroyed, or an excessively high or strong pressure of the vapor greatly melts the thermal adhesive fiber under moisture, whereby a possible partial deformation of the fiber occurs. On the other hand, an excessively weak pressure of the vapor causes a possible difficulty in controlling the uniform jetting with the vapor from the nozzle. In such a case, a quantity of heat sufficient for melt-bonding the fibers cannot be provide for the web, or the vapor cannot pass through the web, whereby the drifting water vapor in the web possibly forms a melt-bond spot or fleck in the thickness direction.

The temperature of the high-temperature water vapor is, for example, about 70 to 150° C., preferably about 80 to 120° C., and more preferably about 90 to 110° C. The speed of the treatment with the high-temperature water vapor is, for example, about not more than 200 m/minute, preferably about 0.1 to 100 m/minute, and more preferably about 1 to 50 m/minute.

If necessary, a conveyor belt may be provided with a predetermined irregular pattern, character, or picture (or graphic). Using such a conveyor, the above-mentioned pattern is transcribed on a surface of a board product to impart a design to the obtained product. In addition, the shaped product of the present invention and the other materials may be laminated to produce a laminated product, or the board product may be formed into a desired shape (e.g., various shapes such as a cylinder or column, a square pole, a spherical shape, and an oval shape).

Sometimes the shaped product having a fiber aggregate structure has water remaining therein after the fibers of the fiber web are partly bonded by the application of moisture and heat. If necessary, the obtained web may be dried. It is necessary that the fibers of the surface of the shaped product be not melted by the heat from a heating element for drying in contact with the shaped product and the surface of the shaped product have no deformation after drying. As long as the form of the fibers is maintained in the shaped product after the drying, the drying can employ a conventional process. For example, a large-scale dryer which is used for drying a nonwoven fabric such as a cylinder dryer or a tenter dryer may be used. However, since the amount of the water remaining in the shaped product is so small that the shaped product can practically be dried by a relatively simple drying means, the drying preferably used is a non-contacting process (e.g., an extreme infrared rays irradiation, a microwave irradiation, and an irradiation of electron beam) or a process employing a hot air.

The shaped product of the present invention is obtained by bonding the web with the thermal adhesive fiber under moisture by applying the high-temperature water vapor on the web as mentioned above. In addition, the shaped product may also be obtained by other conventional processes which bond shaped products obtained by moist-thermal (heat) bonding partly to each other. The conventional process may include a heat pressure melt-bonding (e.g., heat emboss process), a mechanical compressing (e.g., needle punching).

Incidentally, the thermal adhesive fibers under moisture can be melt-bonded to the fibers constituting the fiber web having a fiber aggregate nonwoven structure by immersing the fiber web in a hot water. However, such a process is difficult to control the bonded fiber ratio and to produce a shaped product having a uniform distribution of the bonded fiber ratio. Presumably, the reason for that is as follows: the difference of the amount of the air inevitably contained in the voids in the fiber web causes the irregularity of the voids; when expelling the above-mentioned air, the frequent move of the air deforms the structure of the web; when a roller pulls the fiber web out of the hot water after the wet-heat bonding, the fine structure of the inside of the fiber is deformed by the roller; or when lifting the fiber web out of the hot water after the wet-heat bonding, the difference in the deformation of the fine structure of the inside of the fiber in a lifting direction is caused by the weight of the hot water contained in the fiber web.

INDUSTRIAL APPLICABILITY

The shaped product having a fiber aggregate structure which is obtained by the above mentioned manner has an excellent bending stress and hardness of the compression, besides air-permeability although the density of the shaped product is as low as that of a conventional nonwoven fabric. Accordingly, making use of such properties of the shaped product, for example, the shaped product can be used for an application for which various board materials (such as a timber or a composite panel) are conventionally used or an application in which these board materials require air-permeability, thermal insulation property, sound absorbability, and the like, at the same time. Specifically, the above-mentioned application includes, for example, a board for a building material, an adiabator (or a heat insulator) or a board for heat insulating, a breathable board, a liquid absorber (e.g., a core of a felt-tip (fiber-tip) pen or a highlight pen, an ink retainer for ink-jet printer cartridge, and a core material for a perfume (or aromatic) transpiration such as an aromatic), a sound absorber (e.g., a sound insulating wall material and a sound insulating material for an automobile), a material for constructing or engineering, a buffer (cushioning) material, alight-weight container or a partation material, and a wiping material (e.g., an eraser for a whiteboard, a dishwashing sponge, and a wiper having a pen shape).

Moreover, owing to the high air-permeability, the plate-like shaped product of the present invention which has been laminated on decorative film allows the air contained therebetween to pass through the board, whereby the lift or peeling of the attached film from the plate-like product is prevented. In addition, an adhesive agent of the attached film adheres on the fiber constituting the surface of the shaped product and gets into the voids between the fibers deeply, whereby the film and the plate-like shaped product are strongly adhered to each other.

Furthermore, the shaped product of the present invention can be used as or for a container for carrying a living matter which breaths or a respiratory material since the air can come in the container and out of the container.

In addition, the shaped product containing a flame retardant can be used for an application requiring flame retardancy, e.g., an interior material for an automobile, an inner wall material for a plane, a building material, and furniture.

EXAMPLES

Hereinafter, the following examples are intended to describe this invention in further detail and should by no means be interpreted as defining the scope of the invention. The values of physical properties in Examples were measured by the following methods. Incidentally, the terms "part" and "%" in Examples are by mass unless otherwise indicated.

(1) Melt index (MI) of ethylene-vinyl alcohol-series copolymer

In accordance with JIS K6760, under the condition of a temperature of 190° C. and a load of 21.2 N, the melt index of an ethylene-vinyl alcohol-series copolymer was measured with a melt indexer.

(2) Basis Weight ($g/m^2$)

In accordance with JIS L1913, the basis weight of the product was measured.

(3) Thickness (mm) and Apparent Density ($g/cm^3$)

In accordance with JIS L1913, the thickness of the shaped product was measured, and the apparent density was calculated using the obtained thickness and weight of the product.

(4) Number of crimps

In accordance with JIS L1015 (8.12.1), the number of crimps of the fiber was determined.

(5) Air-permeability

In accordance with JIS L1096, the air-permeability of the shaped product was measured with a Fragzier method.

(6) Durometer Hardness

In accordance with JIS K6253, the durometer hardness was measured with durometer hardness test (type A).

(7) Heat Conductivity

In accordance with "JIS R2616, Testing method for thermal conductivity of insulating fire bricks", the heat conductivity of the shaped product was measured with nonsteady heat wave method.

(8) Bending Stress

In accordance with A method (three-point bending method), which is one of the methods described in JIS K7017, the bending stress of the shaped product was measured using a sample having a width of 25 mm and a length of 80 mm under the condition that the distance between supporting points was 50 mm and the test speed was 2 mm/minute. In the present invention, the maximum stress (peak stress) in a chart obtained from the result was defined as the maximum bending stress. Incidentally, the bending stress in the MD direction and the bending stress in the CD direction were measured. Here, the MD direction means a state of a measuring sample after being prepared by cutting a web fiber so as a machine direction (MD direction) of a web fiber to be parallel to the long side of a measuring sample. On the other hand, the CD direction means a state of a measuring sample after being prepared by cutting a web fiber so as across direction (CD direction) of a web fiber to be parallel to the long side of a measuring sample.

(9) Stresses at 1.5 Times and 2 Times Bending Deflection

In the measurement of the bending stress, after exceeding the bending deflection (bending displacement) at the maximum bending stress (peak stress), the sample was kept bending until a bending deflection became 1.5 times and 2 times as large as the bending deflection at the maximum bending stress. The obtained bending stresses at 1.5 times bending deflection and 2 times bending deflection were the stress at 1.5 times and the stress at 2 times, respectively.

(10) Bonded Fiber Ratio

The bonded fiber ratio was obtained by the following method: taking a macrophotography of the cross section with respect to the thickness direction of a shaped product (100 magnifications) with the use of a scanning electron microscope (SEM); dividing the obtained macrophotography in a direction perpendicular to the thickness direction equally into three; and in each of the three area [a surface area, an central (middle) area, a backside area], calculating the proportion (%) of the number of the cross sections of two or more fibers melt-bonded to each other relative to the total number of the cross sections of the fibers (end sections of the fibers) by the formula mentioned below. Incidentally, in the contact part or area of the fibers, the fibers just contact with each other or are melt-bonded. The fibers which just contacted with each other disassembled at the cross section of the shaped product due to the stress of each fiber after cutting the shaped product for taking the microphotography of the cross section. Accordingly, in the microphotography of the cross section, the fibers which still contacted with each other was determined as being bonded.

Bonded fiber ratio (%)

=(the number of the cross sections of the fibers in which two or more fibers are bonded)/(the total number of the cross sections of the fibers)×100;

providing that in each microphotography, all cross sections of the fibers were counted, and when the total number of the cross sections of the fibers was not more than 100, the observation was repeated with respect to macrophotographies which was taken additionally until the total number of the cross sections of the fibers became over 100. Incidentally, the bonded fiber ratio of each area was calculated, and the difference between the maximum and minimum values thereof was also calculated.

(11) Shape Retention Property of Small Piece of Nonwoven Fiber

A nonwoven fiber sample was cut into a cubic shape having a length of the side of 5 mm. The obtained cubic sample was placed in an Erlenmeyer flask (100 $cm^3$) containing water of 50 $cm^3$. The flask was then set on a shaker ("MK160 type" manufactured by Yamato scientic Co., Ltd.) and shaken for 30 minutes, rotating the flask under the condition of an amplitude of 30 mm and a shaking speed of 60 rpm. After shaking the flask, the change in the form and the performance of the shape retention property of the sample were visually observed. The shape retention property was evaluated by based on the following three-stage criteria.

A: Any changes in the form are hardly observed.

B: Large broken pieces are not observed, but slight changes in the form are observed.

C: Broken pieces are observed.

(12) Mass retention rate

After the above-mentioned treatment, the cubic sample was recovered with a 100-mesh metal net. The recovered sample was dried at a room temperature over night. Then the mass of the dried sample was measured and used for calculation of the mass retention rate.

(13) Fiber-occupancy Ratio

The fiber-occupancy ratio was obtained by the following method: taking a microphotography of the cross section with respect to the thickness direction of the shaped product (100 magnifications) using a scanning electron microscope (SEM); placing a tracing paper on the photograph and making a tracing of the photographed area and the cross sections of the fiber (the bundles of the fibers) with the use of a transmitting light; with the use of an image analyzer (manufactured by Toyobo Co., Ltd.), taking the obtained traced image into a computer with a CCD (charge-coupled device) camera to binaries the drawing; and calculating the proportion of the fiber cross section occupying the whole cross section image, in percentage. The observation of 1 $mm^2$ in each of three areas [a surface area, a central (middle) area, and a backside area] was conducted. The three areas were obtained by dividing the cross section of the shaped product in a direction perpendicular to the thickness direction equally into three. Three values of the fiber-occupancy ratio arbitrarily selected from each of the three areas were used for calculating the average fiber-occupancy ratio. In addition, the fiber-occupancy ratio in each of the three areas was determined and the difference of the maximum and minimum fiber-occupancy ratios in each of the three areas was also calculated. Providing that even the cross section of the fiber was partially appeared in the observation area in the photograph, the observed are a was not excluded from the total cross-sectional as long as the cross section of the fiber partly appeared in the photograph.

Example 1

A sheath-core form conjugated staple fiber ("Sofista" manufactured by Kuraray Co., Ltd., having a fineness of 3 dtex, a fiber length of 51 mm, a mass ratio of the sheath relative to the core of 50/50, a number of crimps of 21/inch, and a degree of crimp of 13.5%) was prepared as a thermal adhesive fiber under moisture. The core component of the conjugated staple fiber comprised a polyethylene terephthalate and the sheath component of the conjugated staple fiber comprised an ethylene-vinyl alcohol copolymer (the content of ethylene was 44 mol % and the degree of saponification was 98.4 mol %). Using the sheath-core form conjugated staple fiber, a card web having a basis weight of about 100 g/m$^2$ was prepared by a carding process. Then seven sheets of the webs were laid on another to obtain a card was having a basis weight of 700 g/m$^2$ in total. The obtained card web was carried onto a 50-mesh stainless steel endless net having a width of 500 mm.

Incidentally, the belt conveyor comprised a pair of a lower conveyor and an upper conveyor. At least one of the conveyors had a vapor spray nozzle disposed behind the conveying surface belt, and a high-temperature water vapor was able to be sprayed to the web to be passing through the conveyors. In addition, the lower and upper conveyors each was equipped with a metal roll for regulating the web thickness (hereinafter, "web thickness regulator roll") distanced from the nozzle in a direction opposite to the web-traveling direction. The web thickness regulator roll of the upper conveyor was disposed as a counterpart of the web thickness regulator roll of the lower conveyor. The lower conveyor had a top conveyor surface (that is, a surface on which the web contacted or traveled) which was flat. On the other hand, the upper conveyor had a down conveyor surface (that is, a surface on which the web contacted or traveled) which curved along the web thickness regulator roll.

Moreover, the upper conveyor was vertically movable, and thus the distance between the web thickness regulators of the upper conveyor and the lower conveyor, respectively, was adjusted to a prescribed one. Furthermore, the upper conveyor was inclined at the web thickness regulator roll at an angle of 30° against the web-traveling direction (against the down conveyor surface in the web-traveling direction of the upper conveyor). The curved or bent part was followed by a flat or straight part parallel to the lower conveyors in the web-traveling direction. Incidentally, the upper conveyor was vertically moved, maintaining a parallel relation to the lower conveyor.

These belt conveyors moved at the same speed in the same direction and formed a structure in which the conveyor belts and the web thickness regulator rolls compressed the fiber web with maintaining a prescribed clearance. This was intended to adjust the web thickness before a vapor treatment, like a calendar step. That is, the card web was fed into the above-mentioned structure to be carried by the lower conveyor forming the clearance with the upper conveyor. The clearance became gradually narrow toward to the web thickness regulator rolls. While the card web was passing through the clearance which was thinner than the thickness of the card web, the thickness of the card web was gradually reduced to the almost same as the clearance formed between the web thickness regulator rolls by compressing the card web by the upper and lower belt conveyors. While the card web was being carried between the belt conveyors in the traveling direction of the card web, the card web was subjected to the vapor treatment with maintaining the obtained thickness. In this process, the linear load of the web thickness regulator roll was adjusted to 50 kg/cm.

Then the card web was carried to be subjected to the vapor treatment by the vapor spray apparatus disposed behind the lower conveyor. The vapor treatment was conducted by jetting a high-temperature water vapor having a pressure of 0.4 MPa from the apparatus to the card web and allowing the high-temperature water vapor to pass through the card web (or allowing the high-temperature water vapor to intersect with the card web), whereby a shaped product of the present invention which had a fiber aggregate nonwoven structure was obtained. The vapor spray apparatus had a first nozzle disposed behind the lower conveyor to spray with the high-temperature water vapor through the conveyor net and a first suction unit which was disposed behind the upper conveyor. Furthermore, the both sides of the card web were treated with the vapor by the use of another spray apparatus was disposed, being distanced from the first one in the web-traveling direction. That is, the spray apparatus had a second nozzle disposed behind the lower conveyor, being distanced from the first one in the web-traveling direction and a second suction unit which was disposed behind the upper conveyor, being distanced from the first one in the web-traveling direction. Incidentally, the vapor spray apparatus which was used had a plurality of nozzles, each having a pore size of 0.3 mm, arrayed in a line along the width direction of the conveyor at 1 mm pitch. The speed of treatment was 3 m/minute, and the distance between the nozzle side of the upper conveyor belt and the suction side of the lower conveyor belt was 10 mm. The nozzles were disposed on back sides of the conveyor belts as close as possible.

The obtained shaped product had a board-like shape, and very hard compared with a conventional nonwoven fabric. When exceeding the bending stress peak, the obtained shaped product neither broke nor showed a sharp decline of the stress. In addition, after conducting the shape retention property test, the changes in the form and the mass of the shaped product were not observed. The results are shown in Tables 1 and 2.

Figure 2:
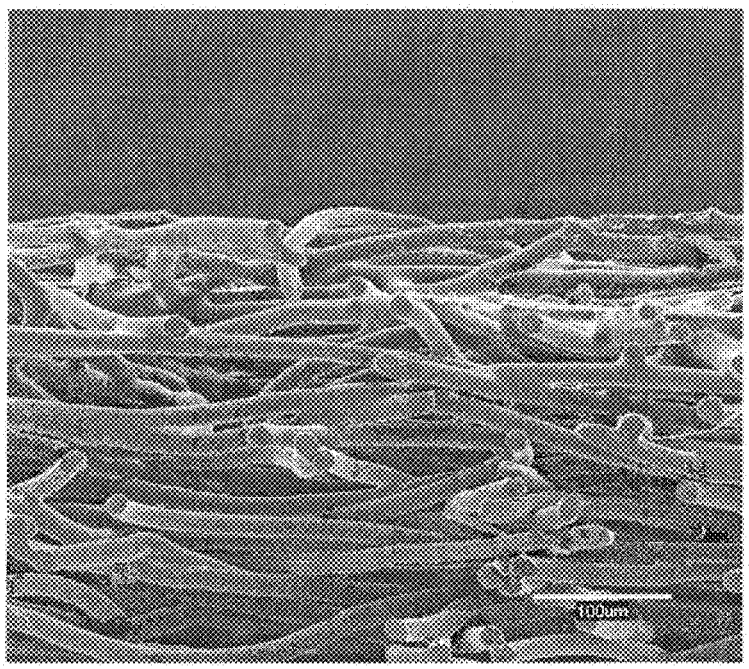
FIG. 2 is an electron micrograph (200 magnifications) of an area near a surface of the cross section with respect to the thickness direction of the shaped product obtained in Example 1.

The results obtained by taking the electron micrographs (200 magnifications) of the cross section with respect to the thickness direction of the obtained shaped product are shown in FIGS. 1 and 2. Incidentally, FIG. 1 is a cross section near the middle area with respect to the thickness direction of the shaped product, and FIG. 2 is a cross section near the surface with respect to the thickness direction the shaped product.

Example 2

Except that 70 parts of the thermal adhesive fiber under moisture used in Example 1 was blended to mixed with 30 parts of a rayon fiber (having a fineness of 1.4 dtex and a fiber length of 44 mm) to produce a card web having a basis weight of about 100 g/m$^2$ and seven sheets of the obtained card webs were laid on another to be subjected to the vapor treatment, using the same manner as in Example 1 the shaped product of the present invention was obtained. The results are shown in Tables 1 and 2. The obtained shaped product also had a board-like shape. Although the shaped product was slightly soft compared with the shaped product obtained in Example 1, the bending behavior of the shaped product was similar to that of the shaped product obtained in Example 1. In addition, in the shape retention property test, although a slight fall off of the fibers was observed, the decrease in mass was about 1%.

Example 3

Except that 50 parts of the thermal adhesive fiber under moisture used in Example 1 was blended or mixed with 30 parts of a rayon fiber used in Example 2 to produce a card web having a basis weight of about 100 g/m$^2$ and seven sheets of the obtained card webs were laid on another to be subjected to the vapor treatment, using the same manner as in Example 1 the shaped product of the present invention was obtained. The results are shown in Tables 1 and 2. The obtained shaped product also had a board-like shape.

Although the shaped product was softer than the shaped product obtained in Example 2, the bending behavior of the shaped product was similar to that of the shaped product obtained in Example 2. In addition, in the shape retention property test, although a slight fall off of the fibers was observed, the decrease in mass was about 4%.

Example 4

Except that 30 parts of the thermal adhesive fiber under moisture used in Example 1 was blended or mixed with 70 parts of a rayon fiber used in Example 2 to produce a card web having a basis weight of about 100 g/m$^2$ and seven sheets of the obtained card webs were laid on another to be subjected to the vapor treatment, using the same manner as in Example 1 the shaped product of the present invention was obtained. The results are shown in Tables 1 and 2. The obtained shaped product also had a board-like shape. Although the shaped product was soft and able to be easily bent compared with the shaped product obtained in Example 1, the bending behavior of the shaped product was similar to that of the shaped product obtained in Example 1. In addition, in the shape retention property test, although a slight fall off of the fibers was observed, the decrease in mass was about 8%.

Example 5

Except that using a sheath-core form conjugated staple fiber ("Sofista" manufactured by Kuraray Co., Ltd., having a fineness of 5 dtex, a fiber length of 51 mm, a mass ratio of core relative to sheath of 50/50, a number of crimps of 21/inch, and a degree of crimp of 13.5%) was used as a thermal adhesive fiber under moisture, using the same manner as in Example 1 the shaped product of the present invention was obtained. Incidentally, the sheath-core form conjugated staple fiber contained a polyethylene terephthalate as a core component and an ethylene-vinyl alcohol copolymer (an ethylene content of 44 mol % and a degree of saponification of 98.4 mol %) as a sheath component of the conjugated staple fiber. The bending behavior of the shaped product was almost the same as that of the shaped product obtained in Example 1. The results are shown in Tables 1 and 2. In addition, after conducting the shape retention property test, the changes in the form and the mass of the shaped product were not observed.

Example 6

Except that ten sheets of the card webs, each of which had been obtained in Example 1 and had a basis weight of about 100 g/m$^2$, were laid on another, using the same manner as in Example 1 the shaped product of the present invention was obtained. The bending behavior of the obtained shaped product was also almost the same as that of the shaped product obtained in Example 1. The results are shown in Tables 1 and 2. The obtained shaped product had a board-like shape and was very hard compared with the shaped products obtained in Examples 1 to 5. However, at a bending deflection which caused a stress exceeding the bending stress peak, the obtained shaped product did not show a sharp decline in the stress.

Example 7

Except that twenty sheets of the card webs, each of which had been obtained in Example 1 and had a basis weight of about 100 g/m$^2$, were laid on another and the upper conveyor to was moved to adjust the distance between the upper and lower belt conveyors to 15 mm, the shaped product of the present invention was obtained using the same manner as in Example 1. The results are shown in Tables 1 and 2. The bending behavior of the obtained shaped product was almost the same as that of the shaped product obtained in Example 6. The shaped product had a board-like shape and was harder than the shaped product obtained in Example 6. In addition, in the shape retention property test, the changes in the form and the mass of the shaped product were not observed.

Example 8

Except that forty sheets of the card webs, each of which had been obtained in Example 1 and had a basis weight of about 100 g/m$^2$, were laid on another and the upper conveyor was moved to adjust the distance between the upper and lower belt conveyors to 20 mm, the shaped product of the present invention was obtained. The results are shown in Tables 1 and 2 using the same manner as in Example 1. The bending behavior of the obtained shaped product was almost the same as that of the shaped product obtained in Example 7. The shaped product had a board-like shape and was harder than the shaped product obtained in Example 7. In addition, in the shape retention property test, the changes in the form and the mass of the shaped product were not observed.

Example 9

Except that four sheets of the card webs on another, each of which had been obtained in Example 1 and had a basis weight of about 100 g/m$^2$, were laid on another, the shaped product of the present invention was obtained using the same manner as in Example 1. The results are shown in Tables 1 and 2. Since the obtained shaped product had a low basis weight, the shaped product was soft and able to be bent easily. However, even after exceeding the bending stress peak, the shaped product did not show a sharp decline in a stress, and the bending behavior of the shaped product was similar to that of the shaped product obtained in Example 1. In addition, in the shape retention property test, the changes in the form and the mass of the shaped product were not observed.

Example 10

Except that a card web having a basis weight of about 150 g/m$^2$ was used and the upper conveyor was moved to adjust the distance between the upper and lower belt conveyors to 6 mm, the shaped product of the present invention was obtained using the same manner as in Example 1. Incidentally, the reason for reducing the distance between the nozzle and the conveyor was that the card web having a lower basis weight and being thin for the distance between the pair of the conveyors carrying the web in Example 1 and the distance between the nozzle of the upper conveyor and the web was also greater, whereby the temperature of the vapor decreased before reaching the card web. The results are shown in Tables 1 and 2. Since the obtained shaped product had a low basis weight, the shaped product was soft and able to be easily bent. However, even after exceeding the bending stress peak, the shaped product did not show a sharp decline in a stress, and the bending behavior of the shaped product was similar to that of the shaped product obtained in Example 1. In addition, in the shape retention property test, although a slight change in the form was observed, the change in the mass of the shaped product was not observed.

Example 11

Except that a card web having a basis weight of about 50 g/m$^2$ was used and the upper conveyor was moved to adjust the distance between the upper and lower belt conveyors to 6 mm, the shaped product of the present invention was obtained using the same manner as in Example 1. The results are shown in Tables 1 and 2. Since the obtained shaped product had a low basis weight, the shaped product was soft and able to be bent easily. However, even after exceeding the bending stress peak, the shaped product did not show a sharp decline in a stress, and the bending behavior of the shaped product was similar to that of the shaped product obtained in Example 1. In addition, in the shape retention property test, the changes in the form and the mass of the shaped product were not observed.

Example 12

Using an extruder, an ethylene-vinyl alcohol copolymer (having an ethylene content of 44 mol %, a degree of saponification of 98 mol %, and an MI of 100 g/10 minutes) was melt-kneaded at 250° C. The melted resin was fed into a melt-blow die head. The resin was weighed on a scale with a gear pump and discharged from a melt-blow nozzle having a plurality of pores disposed in a line at a pitch of 0.75 mm, each having a pore diameter of 0.3 mmϕ. When the resin was discharged therefrom, the melted resin was jetted with a hot wind having a temperature of 250° C. at the same time. Then a discharged fiber flow was collected on a conveyor to obtain a melt-blow nonwoven fabric having a basis weight of 150 g/m$^2$. In the melt-blow process, the amount of discharged resin per pore was 0.2 g/minute/pore, the amount of the hot wind was 0.15 Nm$^3$/minute/cm width, and the distance between the nozzle and the conveyor for collecting was 15 cm. In addition, using a second air jet apparatus disposed directly under the nozzle of the melt-blow apparatus, the melt-blow fiber flow was jetted with an air flow having a temperature of 15° C. at a flow rate of 1 m$^3$/minute/cm width.

The obtained melt-blow nonwoven fabric had an average diameter of the fiber of 6.2 μm and an air-permeability of 23 cm$^3$/cm$^2$/second. Seven sheets of the melt-blow nonwoven fabrics were laid on another by the same manner as in Example 1, and the obtained nonwoven fabric was subjected to the high-temperature treatment under the same condition as in Example 1 to produce a shaped product of the present invention. The results are shown in Tables 1 and 2. The obtained shaped product was hard and had a board-like shape, like the shaped product obtained in Example 1. The bending behavior of the shaped product was similar to that of the shaped product obtained in Example 1. Incidentally, since each fiber had a small and fine diameter, the bonded fiber ratio was high and the air-permeability was somewhat low. In addition, in the shape retention property test, the changes in the form and the mass of the shaped product were not observed.

Comparative Example 1

Except that seven sheets of webs, each having a basis weight of about 100 g/m$^2$ to produce a card web, which had been obtained from a polyethylene terephthalate fiber (having a fineness of 3 dtex and a fiber length of 51 mm), a shaped product was obtained using the same manner as in Example 1. Using a carding process, an attempt to produce a shaped product having a fiber aggregate nonwoven structure was made. However, since the fibers were insufficiently bonded in the obtained product, the product was almost in a web state and it was difficult to carry the product as a board-like product.

Comparative Example 2

Except for using a sheath-core form conjugated staple fiber (having a fineness of 2.2 dtex, a fiber length of 51 mm, a mass ratio of the core relative to the sheath of 50/50, and a degree of crimp of 13.5%) to produce a web having a basis weight of about 100 g/m$^2$ and piling seven sheets of the webs on another to produce a card web, using the same manner as in Example 1a shaped product having a fiber aggregate nonwoven structure was obtained. Incidentally, the conjugated staple fiber contained a polyethylene terephthalate as a core component and a low-density polyethylene (having an MI of 11) as a sheath component. The results are shown in Tables 1 and 2. Although the obtained shaped product had a nonwoven fabric structure due to the fiber bonded, the product was very soft, whereby the shaped product did not have a board-like shape.

Comparative Example 3

Except that using a polyethylene terephthalate fiber (having a fineness of 3 dtex and a fiber length of 51 mm), a web having a basis weight of about 100 g/m$^2$ was obtained by carding process using the same manner as in Example 1. Then five webs were laid on another, and the piled web was subjected to a needle-punching at a punch density of 150 punches/cm$^2$ to produce a needle-punched nonwoven fiber having a basis weight of about 500 g/m$^2$ and a thickness of about 6 mm. The results are shown in Tables 1 and 2. The obtained needle-punched nonwoven fabric was extremely soft and bent by its own weight, whereby the stress at 2 times bending deflection was not able to be measured.

Comparative Example 4

Using 40 parts of the thermal adhesive fiber under moisture used in Example 1 and 60 parts of a polyethylene terephthalate fiber (having a fineness of 3 dtex and a fiber length of 51 mm) a web was produced by a carding process. Then the obtained web was subjected to a needle-punching at a punch density of 130 punches/cm$^2$ to produce a needle punched nonwoven fiber having a basis weight of about 150 g/m$^2$ and a thickness of about 3 mm. The obtained nonwoven fabric was subjected to a wet-heat treatment by immersing the nonwoven fabric in a boiling water having a temperature of 100° C. for 30 seconds. After the treatment, the nonwoven fabric was taken out of the boiling water and immersed in cooling water having a room temperature to solidify the fibers by cooling. Thereafter, the nonwoven fabric was subjected to a centrifugal dewatering and dried under a dry heat at a temperature 110° C. to give a fiber aggregate. The results are shown in Tables 1 and 2. The observation of the inside of the obtained fiber aggregate showed cell-like voids, each having an odd shape, and the separated voids formed by voids adjacent to each other. The obtained fiber aggregate was soft and did not have a so-called board-like shape.

Comparative Example 5

Apparent density and bending stress of a commercially available gypsum board ("Tafuji board" manufactured by Chiyoda Ute Co., Ltd., having a thickness of 9.5 mm) were measured. The apparent density was 11.15 g/cm$^3$ and the bending stress was 13.4 MPa. The gypsum board broke when a bending deflection exceeded by 10% after the bending peak stress, and the stress at 2 times bending deflection was 0 MPa. In addition, the air-permeability was 0 $cm^3/cm^2$/second since it was impossible to measure the air-permeability in accordance with a Fragzier tester method.

[Table 1]

TABLE 1

| | General properties | | | | |
|---|---|---|---|---|---|
| | Basis weight ($g/m^2$) | Thickness (mm) | Density ($g/cm^3$) | Air-permeability ($cm^3/cm^2$/second) | Heat conductivity (W/m · K) |
| Examples | | | | | |
| 1 | 672.3 | 6.818 | 0.099 | 21.3 | 0.038 |
| 2 | 685.1 | 8.125 | 0.084 | 38.6 | 0.037 |
| 3 | 674.8 | 9.972 | 0.068 | 59.3 | 0.034 |
| 4 | 703.1 | 11.051 | 0.064 | 97.7 | 0.035 |
| 5 | 696.6 | 9.537 | 0.073 | 58.1 | 0.043 |
| 6 | 1179.3 | 8.819 | 0.134 | 14.6 | 0.052 |
| 7 | 2058.9 | 9.472 | 0.217 | 8.4 | 0.058 |
| 8 | 4119.3 | 11.411 | 0.361 | 1.8 | 0.069 |
| 9 | 356.2 | 2.757 | 0.129 | 87.1 | 0.058 |
| 10 | 147.1 | 1.208 | 0.122 | 143.4 | 0.051 |
| 11 | 52.2 | 0.915 | 0.057 | 242.0 | 0.034 |
| 12 | 681.1 | 6.712 | 0.101 | 3.3 | 0.046 |
| Comparative Examples | | | | | |
| 1 | 705.3 | 12.048 | 0.059 | 116.3 | 0.032 |
| 2 | 693.4 | 7.272 | 0.095 | 84.7 | 0.048 |
| 3 | 498.7 | 5.966 | 0.084 | 38.2 | 0.041 |
| 4 | 153.1 | 2.971 | 0.052 | — | — |
| 5 | 10925 | 9.5 | 1.150 | 0 | — |

[Table 2]

TABLE 2

| | Bending stress | | Bending stress at 1.5 times bending deflection | Bending stress at 2 times bending deflection | | | | | Shape retention property | |
|---|---|---|---|---|---|---|---|---|---|---|
| | MD | CD | MD | CD | Bonded fiber ratio (%) | | | | | Retention |
| | (MPa) | | (MPa) | (MPa) | Surface | center | Backside | Difference | Shape | (%) |
| Examples | | | | | | | | | | |
| 1 | 0.74 | 0.68 | 0.58 | 0.52 | 23.4 | 23.0 | 18.6 | 4.8 | A | 100 |
| 2 | 0.42 | 0.37 | 0.3 | 0.21 | 17.3 | 16.7 | 15.0 | 2.3 | B | 99 |
| 3 | 0.18 | 0.17 | 0.09 | 0.05 | 14.6 | 13.6 | 11.1 | 3.5 | B | 96 |
| 4 | 0.06 | 0.04 | 0.02 | 0.02 | 11.2 | 10.2 | 9.5 | 1.7 | B | 92 |
| 5 | 0.57 | 0.53 | 0.41 | 0.28 | 35.8 | 34.2 | 34.5 | 1.4 | A | 100 |
| 6 | 1.11 | 0.98 | 0.93 | 0.83 | 17.7 | 16.4 | 21.0 | 4.6 | A | 100 |
| 7 | 2.85 | 4.01 | 2.43 | 2.28 | 72.3 | 69.5 | 68.7 | 3.6 | A | 100 |
| 8 | 13.35 | 12.09 | 12.17 | 11.4 | 84.6 | 82.1 | 78.3 | 6.3 | A | 100 |
| 9 | 0.39 | 0.35 | 0.33 | 0.29 | 28.3 | 26.7 | 25.1 | 3.2 | B | 100 |
| 10 | 0.08 | 0.03 | 0.04 | 0.03 | 21.4 | 32.2 | 35.7 | 14.3 | B | 100 |
| 11 | 0.06 | 0.05 | 0.03 | 0.02 | 18.7 | 20.1 | 16.3 | 3.8 | A | 100 |
| 12 | 0.52 | 0.49 | 0.39 | 0.33 | 44.3 | 33.1 | 26.8 | 17.5 | A | 100 |
| Comparative Examples | | | | | | | | | | |
| 1 | — | — | — | — | — | — | — | — | — | — |
| 2 | — | — | — | — | 8.7 | 7.6 | 7.2 | 1.5 | C | 45 |
| 3 | 0.04 | 0 | — | — | 0 | 0 | 0 | 0 | — | — |
| 4 | — | — | — | — | — | — | — | — | — | — |
| 5 | 13.4 | 13.5 | 0 | 0 | — | — | — | — | — | — |

As apparent from the results shown in Tables 1 and 2, the density of the shaped product of the present invention is as low as that of a conventional nonwoven fabric, and the shaped product has a very high bending stress and a "tenacity" without showing a sharp decrease in stress even after exceeding the bending stress peak. In addition, although the shaped product of the present invention has an excellent air-permeability and lightness in weight, the product is as advantageous as a gypsum board.

Example 13

A boron-containing flame retardant ("Fireless B" manufactured by Trust life Co., Ltd.) was prepared, which comprised an aqueous solution containing 100 parts of water, 20 parts of boric acid, and 25 parts of borax as a main component. The shaped product obtained in Example 1 was immersed in the flame-retardant aqueous solution, and the shaped product was wringed with a nip roller. Thereafter, the shaped product was dried in a hot air heater at a temperature of 100° C. for 2 hours to produce a flame-retardant shaped product. The flame-retardant (solid content) adhered relative to the whole mass of the shaped product was 3.4%. Using a gas burner, the combustion test of the obtained flame-retardant shaped product was conducted. When flame was applied to the flame-retardant shaped product for 30 seconds, the surface of the shaped product was carbonized and became black, but did not ignite. The shaped product showed a good flame retardancy.

Example 14

Expect for using a sheath-core form conjugated staple fiber a card web having a basis weight of about 4000 $g/m^2$ was prepared by a carding process and equipping belt conveyors with an endless net comprising a polycarbonate, a shaped product having a fiber aggregate nonwoven structure was obtained using the same manner as in Example 1.

The results are shown in Tables 3 and 4. The obtained shaped product was very hard and had a plate-like shape. When the shaped product was kept bending even after exceeding a bending deflection at the maximum bending stress, the shaped product neither broke nor showed an extreme decrease in stress.

Example 15

Except for using a card web having a basis weight of about 4000 g/m$^2$ formed by blending 95 parts of the thermal adhesive fiber under moisture used in Example 1 with 5 parts of a rayon fiber (having a fineness of 1.4 dtex and a fiber length of 44 mm), the shaped product of the present invention using the same manner as in Example 14. The results are shown in Tables 3 and 4. The obtained shaped product also had a board-like shape. The shaped product was slightly softer then the shaped product obtained in Example 14. However, the bending behavior and hardness of the compression of the shaped product were similar to those of the shaped product obtained in Example 14.

Example 16

Except for using a card web having a basis weight of about 4000 g/m$^2$ formed by blending 85 parts of the thermal adhesive fiber under moisture used in Example 1 with 15 parts of a rayon fiber used in Example 2, the shaped product of the present invention using the same manner as in Example 1. The results are shown in Tables 3 and 4. The shaped product was softer then the shaped product obtained in Example 15. However, the bending behavior and hardness of the compression of the shaped product were similar to those of the shaped product obtained in Example 15.

Example 17

Except for using a sheath-core form conjugated staple fiber ("Sofista" manufactured by Kuraray Co., Ltd., having a fineness of 5 dtex, a fiber length of 51 mm, a mass ratio of the core relative to the sheath of 50/50, a number of crimps of 21/inch, and a degree of crimp of 13.5%) as a thermal adhesive fiber under moisture, the shaped product of the present invention was obtained using the same manner as in Example 14. Incidentally, the conjugated staple fiber contained a polyethylene terephthalate as a core component and an ethylene-vinyl alcohol copolymer (an ethylene content of 44 mol % and the degree of saponification of 98.4 mol %) as a sheath component. The results are shown in Tables 3 and 4. The bending behavior and hardness of the compression of the shaped product were also almost the same as those of the shaped product obtained in Example 14.

Example 18

Except for using a card web having a basis weight of about 4000 g/m$^2$ obtained in Example 14 and moving the upper conveyor to adjust the distance between the upper and lower belt conveyors to 6 mm, the shaped product of the present invention was obtained using the same manner as in Example 14. The results are shown in Tables 3 and 4. The obtained shaped product was a board-like shape and very hard compared with the products obtained in Examples 14 to 17. However, when the shaped product was kept bending even after exceeding a bending deflection which had caused the maximum bending stress, the shaped product did not show an extreme decrease in stress.

Example 19

Except for preparing a card web having a basis weight of about 1200 g/m$^2$ formed from the thermal adhesive fiber under moisture used in Example 1, the shaped product of the present invention was obtained using the same manner as in Example 14. The results are shown in Tables 3 and 4. The obtained shaped product was a board-like shape and very soft compared with the shaped products obtained in Examples 14 to 18. However, when the shaped product was kept bending even after exceeding a bending deflection which had caused the maximum bending stress, the shaped product did not show an extreme decrease in stress.

Example 20

Figure 3:
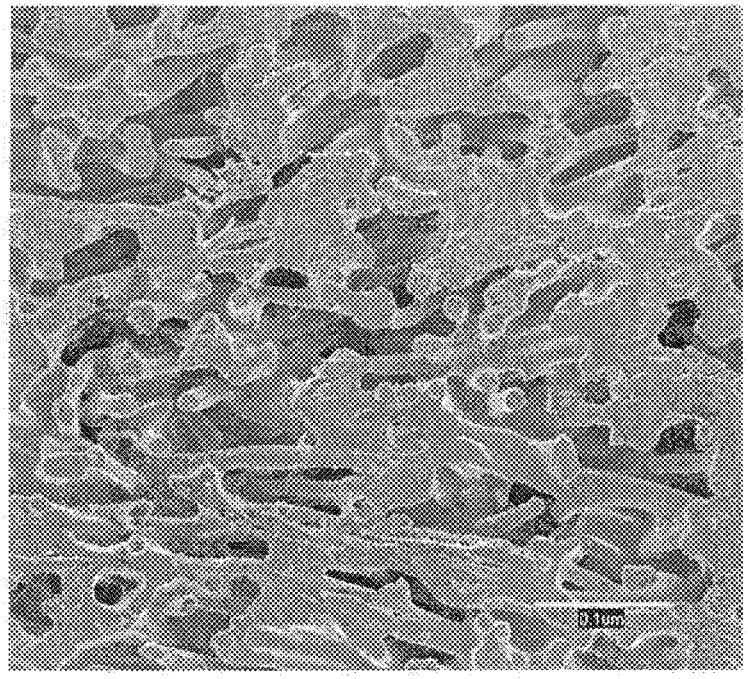
FIG. 3 is an electron micrograph (200 magnifications) of an area around middle of the cross section with respect to the thickness direction of the shaped product obtained in Example 20.
Figure 4:
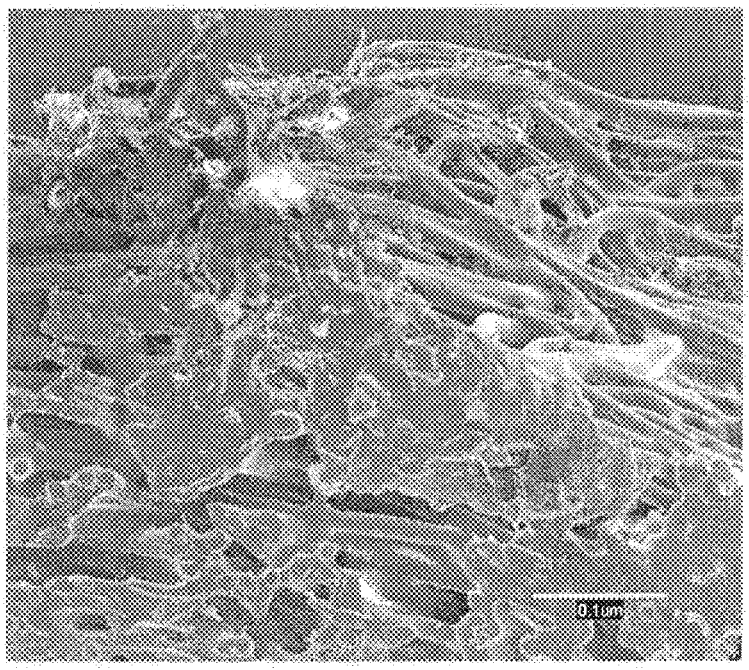
FIG. 4 is an electron micrograph (200 magnifications) of an area near a surface of the cross section with respect to the thickness direction of the shaped product obtained in Example 20.

Except for preparing a card web having a basis weight of about 7000 g/m$^2$ formed from the thermal adhesive fiber under moisture used in Example 1 and increasing a pressure to adjust the linear load against the web thickness regulator rolls to 100 kg/cm, the shaped product of the present invention was obtained using the same manner as in Example 1. The results are shown in Tables 3 and 4. The bending behavior of the obtained shaped product was similar to that of the shaped product obtained in Example 19. In addition, the shaped product was a hardboard-like shape. The electron micrographs (200 times) of the cross section in the thickness direction of the obtained shaped product are shown in FIGS. 3 and 4. Incidentally, FIG. 3 is a photograph of the area near the middle of the cross section with respect to the thickness direction, and FIG. 4 is a photograph of the area near the surface of the cross section with respect to the thickness direction.

Example 21

Except for preparing a web from 70 parts of the thermal adhesive fiber under moisture used in Example 1 and 30 parts of a polyethylene terephthalate fiber (having a fineness of 3 dtex and a fiber length of 51 mm), the shaped product of the present invention was obtained using the same manner as in Example 14. The results are shown in Tables 3 and 4. The obtained shaped product had a board-like shape. The product was softer and more light weight than the shaped products obtained in Examples 16 to 20.

Comparative Example 6

The density and bending stress of a commercially available medium-density fiber board (MDF manufactured by Storio Co., Ltd., having a thickness of 9 mm) were measured. The density was 0.731 g/cm$^3$ and the bending stress in the MD direction was 38.2 MPa (incidentally, the MD direction means the long side direction of the board). The fiber board showed the maximum bending stress at a bending deflection of 2 mm and then broke with a sharp decrease in bending stress by 5.7 MPa. The shaped product had a stress at 1.5 times bending deflection of 5.1 MPa. In addition, the air-permeability of the shaped product was 0 cm$^3$/cm$^2$/second since it was impossible to measure the air-permeability by a Fragzier tester method. The results are shown in Tables 3 and 4.

[Table 3]

TABLE 3

| | General properties | | | | Heat |
|---|---|---|---|---|---|
| | Basis weight ($g/m^2$) | Thickness (mm) | Apparent density ($g/cm^3$) | Air-permeability ($cm^3/cm^2/second$) | conductivity (W/m · K) |
| Examples | | | | | |
| 14 | 3982 | 9.8 | 0.397 | 2.6 | 0.073 |
| 15 | 4030 | 10.1 | 0.399 | 8.1 | 0.080 |
| 16 | 4015 | 10.2 | 0.394 | 12.3 | 0.079 |
| 17 | 3993 | 9.9 | 0.403 | 14.1 | 0.083 |
| 18 | 4051 | 6.2 | 0.653 | 1.2 | 0.095 |
| 19 | 1217 | 9.8 | 0.124 | 17.0 | 0.052 |
| 20 | 6989 | 10.1 | 0.692 | 0.8 | 0.093 |
| 21 | 1352 | 10.9 | 0.124 | 12.3 | — |
| Comparative Example | | | | | |
| 6 | 6582 | 9.0 | 0.731 | 0 | 0.113 |

| | Fiber-occupancy ratio (%) | | | | | |
|---|---|---|---|---|---|---|
| | Average | Surface | Center | Backside | Difference | Durometer hardness |
| Examples | | | | | | |
| 14 | 56.1 | 62.2 | 47.9 | 58.3 | 14.3 | 88 |
| 15 | 43.8 | 51.2 | 33.2 | 47.0 | 18.0 | 63 |
| 16 | 27.0 | 30.8 | 32.2 | 17.9 | 14.3 | 58 |
| 17 | 48.4 | 50.3 | 45.7 | 49.1 | 4.6 | 76 |
| 18 | 68.2 | 72.7 | 58.2 | 73.6 | 15.4 | >99 |
| 19 | 23.1 | 24.6 | 23.7 | 20.9 | 3.7 | 54 |
| 20 | 77.9 | 83.1 | 68.7 | 82.0 | 14.4 | >99 |
| 21 | 16.0 | 18.2 | 14.2 | 15.6 | 4.0 | 46 |
| Comparative Example | | | | | | |
| 6 | — | — | — | — | — | — |

[Table 4]

TABLE 4

| | Bending stress | | Bending stress at 1.5 times bending deflection | | Bonded fiber ratio (%) | | | | Shape retention | |
|---|---|---|---|---|---|---|---|---|---|---|
| | MD | CD | MD | CD | | | | | | Retention |
| | (MPa) | | (MPa) | | Surface | Center | Backside | Difference | Shape | (%) |
| Examples | | | | | | | | | | |
| 14 | 13.4 | 12.1 | 6.9 | 6.1 | 62.2 | 47.9 | 58.3 | 14.3 | A | 100 |
| 15 | 11.3 | 9.6 | 5.2 | 4.1 | 51.2 | 33.2 | 47.0 | 18.0 | A | 100 |
| 16 | 8.7 | 6.4 | 3.2 | 2.5 | 30.8 | 32.2 | 17.9 | 14.3 | A | 100 |
| 17 | 16.3 | 14.1 | 12.7 | 11.0 | 50.3 | 45.7 | 49.1 | 4.6 | A | 100 |
| 18 | 11.2 | 9.3 | 5.4 | 3.3 | 72.7 | 58.2 | 73.6 | 15.4 | A | 100 |
| 19 | 2.8 | 1.8 | 1.1 | 0.4 | 24.6 | 23.7 | 20.9 | 3.7 | A | 100 |
| 20 | 38.2 | 32.1 | 31.6 | 27.2 | 83.1 | 68.7 | 82.0 | 14.4 | A | 100 |
| 21 | 1.8 | 1.3 | 0.4 | 0.2 | 18.2 | 14.2 | 15.6 | 4.0 | A | 100 |
| Comparative Example | | | | | | | | | | |
| 6 | 38.2 | 37.1 | 5.1 | 4.7 | — | — | — | — | — | — |

As apparent from the results shown in Tables 3 and 4, although the density of the shaped product of the present invention is as low as that of a conventional nonwoven fabric, the shaped product has a very high bending stress and a "tenacity" without showing a sharp decrease in stress even after exceeding the bending stress peak. While the shaped product of the present invention has an excellent air-permeability and a lightness in weight, the product is as advantageous as a wood fiber board in terms of hardness.

Example 21

A boron-containing flame retardant ("Fireless B" manufactured by Trust life Co., Ltd.) was prepared, which comprised an aqueous solution containing 100 parts of water, 20 parts of boric acid, and 25 parts of borax as a main component. The shaped product obtained in Example 14 was immersed in the aqueous solution containing the flame-retardant, and the shaped product was wringed with a nip roller. Thereafter, the shaped product was dried in a hot air heater at a temperature of 100° C. for 2 hours to produce a flame-retardant shaped product. The flame retardant (solid content) adhered relative to the whole mass of the shaped product was 3.4%. Using a gas burner, the combustion test of the obtained flame-retardant shaped product was conducted. When flame was applied to the flame-retardant shaped product for 30 seconds, the surface of the shaped product was carbonized and became black, but did not ignite. The shaped product showed a good flame retardancy.

The invention claimed is:

1. A shaped product comprising a thermal adhesive fiber under moisture and having a fiber aggregate nonwoven structure, wherein the thermal adhesive fibers under moisture are melted to bond to fibers constituting the fiber aggregate nonwoven structure and bonded fiber ratio is not more than 85%, the thermal adhesive fiber under moisture comprises an ethylene-vinyl alcohol-series copolymer, the ethylene-vinyl alcohol-series copolymer forms at least one continuous area of the surface of the thermal adhesive fiber under moisture in the fiber length, the shaped product has a bonded fiber ratio of not more than 85% in each of three areas and a difference between the maximum and minimum bonded fiber ratios of not more than 20% in each of the three areas, providing that the shaped product is cut across the thickness direction and the cross section is divided in a direction perpendicular to the thickness direction equally into three to give the three areas, and the shaped product having an apparent density of 0.05 to 0.7 g/cm$^3$, a maximum bending stress of not less than 0.05 MPa in at least one direction, and a bending stress of not less than ⅕ of the maximum bending stress at 1.5 times as large as the bending deflection at the maximum bending stress.

2. A shaped product according to claim 1, which has an apparent density of 0.2 to 0.7 g/cm$^3$ and a bending stress of not less than ⅓ of the maximum bending stress at 1.5 times as large as bending deflection at the maximum bending stress.

3. A shaped product according to claim 1, which has a fiber-occupancy ratio of 20 to 80% in each of three areas and a difference between the maximum and minimum fiber-occupancy ratios of not more than 20% in each of the three areas, providing that the shaped product is cut across the thickness direction and the cross section is divided in a direction perpendicular to the thickness direction equally into three to give the three areas.

4. A shaped product according to claim 1, which has an air-permeability of 0.1 to 300 cm$^3$/cm$^2$/second measured in accordance with a Fragzier tester method.

5. A shaped product according to claim 1, which has a heat conductivity of 0.03 to 0.1 W/m·K.

6. A shaped product according to claim 1, which further comprises a non thermal adhesive fiber under moisture, wherein the proportion (mass ratio) of the thermal adhesive fiber under moisture relative to the non thermal adhesive fiber under moisture (the thermal adhesive fiber under moisture/the non thermal adhesive fiber under moisture) is 20/80 to 99/1.

7. A shaped product according to claim 1, wherein the thermal adhesive fiber under moisture additionally comprises a non thermal adhesive resin under moisture.

8. A shaped product according to claim 7, wherein the content of ethylene unit in the ethylene-vinyl alcohol-series copolymer is 10 to 60 mol %.

9. A shaped product according to claim 1, wherein the thermal adhesive fiber under moisture additionally comprises a non thermal adhesive resin under moisture, the proportion (mass ratio) of the ethylene-vinyl alcohol-series copolymer relative to the non thermal adhesive resin under moisture [the former/the latter] is 90/10 to 10/90.

10. A shaped product according to claim 1, wherein the thermal adhesive fiber under moisture is a sheath-core form conjugated fiber having a sheath part comprising a thermal adhesive resin under moisture and a core part comprising a non thermal adhesive resin under moisture selected from the group consisting of a polypropylene-series resin, a polyester-series resin, and a polyamide-series resin.

11. A shaped product according to claim 1, wherein the thermal adhesive fiber under moisture is a sheath-core form conjugated fiber having a sheath part comprising said ethylene-vinyl alcohol-series copolymer and a core part comprising a polyester-series resin.

12. A shaped product according to claim 1, which comprises at least one selected from the group consisting of a boron-containing flame retardant and a silicon-containing flame retardant.

13. A shaped product according to claim 1, which is a shaped product having a heat insulation property and/or air-permeability.

14. A building board comprising a shaped product recited claim 1.

15. A shaped product according to claim 1, wherein the thermal adhesive fiber under moisture comprises a thermoplastic resin which softens with or by water having a temperature of about 80-120° C. to bond to itself or to other fibers.

* * * * *